US011680743B2

(12) United States Patent
Son

(10) Patent No.: US 11,680,743 B2
(45) Date of Patent: Jun. 20, 2023

(54) DOOR OPENING DEVICE AND REFRIGERATOR INCLUDING SAME

(71) Applicant: LG Electronics Inc., Seoul (KR)

(72) Inventor: Young Hun Son, Seoul (KR)

(73) Assignee: LG Electronics Inc., Seoul (KR)

( * ) Notice: Subject to any disclaimer, the term of this patent is extended or adjusted under 35 U.S.C. 154(b) by 54 days.

(21) Appl. No.: 17/353,289

(22) Filed: Jun. 21, 2021

(65) Prior Publication Data

US 2022/0011040 A1 Jan. 13, 2022

(30) Foreign Application Priority Data

Jul. 10, 2020 (KR) ..... 10-2020-0085331

(51) Int. Cl.
*F25D 23/02* (2006.01)
*E05B 7/00* (2006.01)
*E05B 17/00* (2006.01)

(52) U.S. Cl.
CPC ..... *F25D 23/028* (2013.01); *E05B 7/00* (2013.01); *E05B 17/0033* (2013.01)

(58) Field of Classification Search
CPC ..... E05B 7/00; E05B 17/0033; E05F 11/54; E05Y 2900/31; E05Y 2201/68; F25D 23/028
See application file for complete search history.

(56) References Cited

U.S. PATENT DOCUMENTS 7,784,219 B2 * 8/2010 Yoshikawa ..... F25D 23/028 292/336.3
7,975,351 B2 * 7/2011 King ..... E05F 13/02 16/110.1
2008/0000052 A1 * 1/2008 Hong ..... F25D 23/028 16/382
2015/0275545 A1 * 10/2015 Lee ..... F25D 23/028 49/460

FOREIGN PATENT DOCUMENTS

CN 202467332 10/2012
CN 103184811 A * 7/2013
CN 108344237 A * 7/2018 ..... E05B 1/0053
CN 109000415 A * 12/2018 ..... F25D 23/028
CN 110195958 A * 9/2019
DE 102007021948 1/2008
DE 102013012232 A1 * 1/2015 ..... E05B 1/0015
(Continued)

OTHER PUBLICATIONS

Translation CN202467332U, 11 pages (Year: 2012).*
(Continued)

*Primary Examiner* — Andrew M Roersma
(74) *Attorney, Agent, or Firm* — Fish & Richardson P.C.

(57) ABSTRACT

A refrigerator includes a door opening device and a handle assembly including a handle body and a handle cover assembled with each other. The handle body may have a structure for rotating the handle assembly, and when the handle cover is coupled to the handle body, the handle cover may constitute at least a portion of a surface of the handle body. Additionally, a driving arm may be provided in the
(Continued)

handle cover and configured to push a push rod while the driving arm rotates with the handle body. The driving arm is made of metal.

20 Claims, 12 Drawing Sheets

(56) References Cited

FOREIGN PATENT DOCUMENTS

| | | | | | |
|---|---|---|---|---|---|
| EP | 0598979 | A1 * | 6/1994 | ..... | E05B 17/0033 |
| EP | 1174668 | | 1/2002 | | |
| EP | 1174668 | A1 * | 1/2002 | ..... | E05B 17/0033 |
| EP | 1524483 | A1 * | 4/2005 | ..... | E05B 17/0033 |
| EP | 2336689 | | 6/2011 | | |
| EP | 2602575 | A2 * | 6/2013 | ..... | E05B 1/0015 |
| KR | 101897275 | | 9/2018 | | |
| WO | WO-2010139537 | A1 * | 12/2010 | ..... | E05B 1/0015 |

OTHER PUBLICATIONS

Extended European Search Report in European Appln. No. 21180698.9, dated Nov. 30, 2021, 8 pages.
Office Action in Australian Appln. No. 2021204171, dated Apr. 21, 2022, 4 pages.

* cited by examiner

DOOR OPENING DEVICE AND REFRIGERATOR INCLUDING SAME

CROSS REFERENCE TO RELATED APPLICATION

The present application claims priority to Korean Patent Application No. 10-2020-0085331, filed on Jul. 10, 2020, the entire contents of which are incorporated herein for all purposes by this reference.

TECHNICAL FIELD

The present disclosure relates generally to a door opening device. More particularly, the present disclosure relates to a door opening device and a refrigerator including the same, in which a push rod operating in cooperation with a handle protrudes toward the body of the refrigerator so as to open the door by a predetermined angle.

BACKGROUND

Generally, a refrigerator is a home appliance that can store food at low temperatures in an internal storage space that is shielded by a door. To this end, the refrigerator is configured to store the stored food in an optimal state by cooling the inside of the storage space by using cold air generated through heat exchange with refrigerant circulating in a refrigeration cycle.

Recently, the refrigerator is gradually becoming multi-functional in accordance with change in dietary life and the trend of high-end products, and various devices are being added thereto so as to increase the convenience of a user. In addition, as the capacity of a storage room of the refrigerator is gradually increasing, large refrigerators are being made.

However, as a refrigerator becomes larger, the weight of the door of the refrigerator becomes heavier, so opening the door is difficult. Particularly, recently, the door is often provided with a space for storage, and in this case, force required to open the door is inevitably increased.

Additionally, factors that increase force required to open the refrigerator door may include the magnetic force of the magnet built in a gasket of the door to prevent leakage of cold air in a refrigerator, and the instantaneous occurrence of negative pressure lower inside the refrigerator than atmospheric pressure outside the refrigerator as warm air introduced into refrigerator rapidly contracts. All of these factors increase initial manipulation force required to open the door, which deteriorates usability.

To solve these problems, in Korean Patent Application Publication No. 10-2012-0124693 and European Patent No. EP1174668, a door opening device is disclosed in which a push rod protrudes from a handle for opening a refrigerator door. In the structure of the above technology, when the handle is rotated, the push rod protrudes and pushes the door from the body of the refrigerator.

Since such a door opening device is configured so that many parts, including the push rod, operate in cooperation with each other, there is a risk that the parts operating in cooperation with each other may be easily worn or damaged as the operation of the parts is repeated. To solve this problem, the parts operating in cooperation with each other may be made of metal to increase durability thereof, but a structure for the cooperative operation is complex, so it is difficult to make the parts of metal, and when the parts are manufactured by casting, manufacturing costs increase.

Meanwhile, recently, when consumers select electronic products, there is a tendency to consider the exterior design of the electronic products as important. Reflecting this trend, the exterior of electronic products is often configured as a metal case. However, as described above, due to the complexity of the structure of the door opening device, it is difficult to make the entire case thereof of metal. Of course, although only some parts may be made of metallic materials and other parts may be made of other materials such as synthetic resin. However, in this case, there is a problem in that the door opening device cannot look unified and beautiful to consumers.

SUMMARY

Accordingly, the present disclosure has been made keeping in mind the above problems occurring in the related art, and the present disclosure is intended to propose a door opening device, in which a driving part pushing a push rod of the door opening device may be designed to have a simple shape and may easily be made of metal.

In addition, the present disclosure is intended to propose a door opening device, in which the entire front surface of a handle exposed toward a user, the handle including a driving part pushing the push rod, may be configured as one part made of metal.

In order to achieve the above objectives, according to one aspect of the present disclosure, a handle body and a handle cover may be coupled to each other to constitute a handle assembly. The handle body may have a structure for rotating the handle assembly. When the handle cover is coupled to the handle body, the handle cover may constitute at least a portion of a surface of the handle body. In addition, a driving arm may be provided in the handle cover to push a push rod while rotating with the handle body, and may be made of a metal material. Accordingly, a complex structure for the rotation and mounting of the handle may be constituted by the handle body which may be injection molded, and a simple structure for opening a refrigerator door by pushing the push rod may be constituted by the handle cover. Accordingly, the handle cover made of metal may push the push rod and thus the wear rate and damage rate of components may be significantly decreased.

In addition, in the present disclosure, the entire front surface of the handle exposed in a direction toward a user, the handle including the driving arm pushing the push rod, may be configured as one handle cover made of metal. In this case, most of the exposed portions of the handle may be made of metal which may look unified and luxuriously beautiful to a user.

Additionally, in the present disclosure, a guide bracket may be fixed to a door assembly, and a guide part may extend on the guide bracket. The push rod may be coupled to the guide bracket and may move along the guide part. The push rod may selectively push the cabinet at which the door assembly is installed while the push rod moves on the guide part. A link block may be coupled rotatably to the guide bracket, and a return spring may be connected to the link block, the return spring supplying elastic force to the link block in a direction of moving the link block to an initial position after the link block and the guide bracket rotate relative to each other.

In addition, the handle body may be coupled to the link block, so the handle body and the link block may rotate relative to the guide bracket. The handle cover may be coupled to the handle body and may constitute at least a portion of a surface of the handle body. In this case, the driving arm may be provided in the handle cover and may push the push rod while rotating with the handle body, and may be made of metal. Accordingly, in the handle assembly, only the handle cover may be made of metal, so the door opening device may have lighter weight and lower material cost, compared to a handle whose entirety is made of metal.

In addition, the handle cover may include a cover body covering the front surface of a handlebar of the handle body and the driving arm. The driving arm may extend from the cover body in a direction of the link block and may cover a portion of the handle body, and the end part of the driving arm may push the push rod. Here, the driving arm may be made of metal, and thus may have high wear resistance.

In addition, each of the cover body constituting the handle cover and the driving arm extending from the cover body may have the same cross-sectional shape along the longitudinal direction of the handle cover. In this case, although the opposite ends of the handle cover may be open, the open opposite ends may be shielded by the handle body. Due to such a structure, the handle cover may be easily manufactured by extrusion.

Furthermore, a link connection part open toward the link block may be provided in the handle body. With at least a portion of the link block inserted to the link connection part, the link block may be fixed to the handle body. Accordingly, even without a separate cover, it is possible to minimize the exposure of parts related to rotation to the outside.

In addition, the handle body may include the handlebar extending in one direction and the link connection part. The link connection part may extend from the handlebar in the direction of the link block. The link connection part may cover and shield at least a portion of the link block, and may be coupled to the link block. In this case, the handle cover may be coupled to the forward-directed front surfaces of the handlebar and the link connection part in the surfaces of the handlebar and the link connection part. The link connection part may function to cover and protect parts for rotation, which may further increase the durability of the parts.

Additionally, the link connection part may include a pair of inner and outer plates extending from the handlebar and located at heights different from each other. In the pair of horizontal plates, the outer plate arranged at an outer side along the longitudinal direction of the handle body may shield the upper part of the link block and an open end part of the handle cover. Accordingly, even without a separate cover, the exposure of a portion of each of the link block and the shielding cover to the outside may be minimized.

In addition, the handle body and the handle cover may be provided with the assembly jaw and an assembly hook, respectively, and thus may be assembled with each other. Accordingly, the handle body and the handle cover may be assembled with each other without a separate fastener or adhesive.

In this case, the assembly hook of the handle cover may include a guide hook and a main hook. The guide hook may be formed at an end part of the driving arm pushing the push rod, and may be held in and fixed to an edge of the handle body. The main hook may protrude from the inner surface of the cover body of the handle cover toward the surface of the handle body, and may be held in the assembly jaw of the handle body. Accordingly, when the handle cover is rotated with a side of the handle cover held in the handle body, the handle body and the handle cover may be assembled with each other.

Furthermore, the main hook and the assembly jaw may be arranged to interfere with each other in a rotating course of the handle cover in a direction in which the handle cover is in close contact with the handle body, with the guide hook held in an edge of the handle body, and when the handle cover is rotated with the guide hook held in the edge of the handle body, the main hook may move over and be engaged with the assembly jaw. This fastening method may increase the assemblability of the handle assembly.

In addition, the main hook may be composed of a first hook and a second hook. When the handle cover is rotated in the direction in which the handle cover is in close contact with the handle body with the guide hook held in the edge of the handle body, the first hook and the second hook may rotate to have radiuses different from each other. Accordingly, the first hook and the second hook may be held in the first assembly jaw and the second assembly jaw, respectively, with time difference, so force required to assemble the handle body and the handle cover with each other may be distributed.

In addition, the first hook and the second hook may have hook ends, respectively, protruding in directions opposite to each other at end parts thereof, and the first assembly jaw and the second assembly jaw held in the first hook and the second hook, respectively, may protrude toward the hook ends. In this case, the handle cover and the handle body may be engaged with each other in directions opposite to each other, which may increase the force of maintaining the assembling thereof.

Additionally, the multiple assembly jaws may be arranged at the handle body along the longitudinal direction of the handle body. The multiple assembly jaws may be spaced apart from each other with distances therebetween. Accordingly, when the assembly jaws are arranged by being spaced apart from each other, it is possible to prevent excessive increase in engaging force between the handle body and the handle cover.

Furthermore, a part of the link block may protrude toward the handle cover from the handle body, and may support a side of the main hook constituting the assembly hook. When the part of the link block supports the first hook and the second hook therebetween, the part of the link block may prevent the first hook and the second hook from being elastically transformed in increasing directions of distance between the first hook and the second hook.

In addition, in an initial position of the handle body, a surface of a pressed part of the push rod may be in surface contact with and may be supported by a surface of the link block, and the driving arm may also be in contact with the same surface as the surface of the pressed part. Accordingly, the link block and the driving arm may support the push rod, so the shaking of the push rod may be prevented more reliably.

In addition, at least a portion of the link block may be received in the link connection part provided in the handle body, and at least a portion of a bracket rotation part provided in the guide bracket and connected rotatably to the link block may be received in the link block, so the portion of each of the bracket rotation part and the link block may be received in the link connection part. In this case, the link connection part may prevent the link block and the bracket rotation part from being spaced apart from each other during the rotation of the handle assembly.

In addition, the bracket rotation part of the guide bracket and the link block may be connected rotatably to each other by a rotating shaft. The return spring may be fitted over the rotating shaft and may provide rotational force to the link block in the direction of moving the link block to an initial position.

In this case, the return spring may be arranged inside the bracket rotation part, and may be supported by the bracket rotation part and the link block. Accordingly, the return spring may provide elastic force to the bracket rotation part and the link block in directions in which the bracket rotation part and the link block rotate relative to each other.

In addition, a bracket stopper may protrude from a surface of a bracket rotation part provided in the guide bracket, and a stopping surface may be provided in the link block, the stopping surface interfering with the bracket stopper while the link block rotates and limiting the rotation of the link block. The bracket stopper and the stopping surface may function as a stopper limiting the rotation of the link block.

Additionally, a stopping rib may protrude at the link block such that the stopping rib extends in a direction parallel to a rotating shaft of the link block, the stopping rib configured to interfere with a surface of the bracket rotation part of the guide bracket during the rotation of the link block so as to limit the rotation of the link block. The stopping rib may be another stopper limiting the rotation of the link block.

Additionally, the push rod may include a push head and the guide leg. The push head may push the cabinet at which the door assembly is installed. The guide leg may extend from the push head toward the driving arm such that the guide leg has a cantilever shape and may be composed of a pair of guide legs connected to the guide parts of the guide bracket. Furthermore, the pressed part pressed by the driving arm may be provided at the end part of the guide leg. The pair of guide legs may be spaced apart from each other, which improves assemblability.

In addition, a guide groove may be formed in the pressed part, and may be fitted over the bracket rotation part of the guide bracket, so the push rod may be guided by the bracket rotation part during the rectilinear motion of the push rod.

As described above, the door opening device and a refrigerator including the same according to the present disclosure has the following effects.

The door opening device of the present disclosure may include the handle body and the handle cover. A complex structure for the rotation and mounting of the handle may be constituted by the handle body, which may be injection-molded, and a simple structure for opening the door by pushing the push rod may be constituted by the handle cover. Accordingly, the handle cover may be made by extruding metal. Accordingly, the handle cover made of metal may push the push rod, which may significantly reduce the wear rate or damage rate of parts of the handle cover. As a result, the durability of the door opening device of the present disclosure may be improved.

In addition, in the present disclosure, when assembled with the handle body, the handle cover may cover the front surface of the door opening device. Accordingly, the front surface of the door opening device exposed toward a user may be constituted by the handle cover. The entirety of the handle cover may be made only of metal. Accordingly, most of the exposed parts are made of metal, which may look unified and luxuriously beautiful to a user, whereby the beauty of an electronic device such as a refrigerator may be enhanced.

Additionally, in the door opening device of the present disclosure, the entirety of the handle may not be made of metal, but a fundamental frame thereof may be constituted by the handle body which is injection-molded, and only the handle cover covering the handle body may be made of metal. Accordingly, the door opening device may have lighter weight and lower material cost, compared to a handle whose entirety is made of metal.

Particularly, the complex structure may be constituted by the handle body made of synthetic resin, and the handle cover may be configured to cover the surface of the handle body, whereby the door opening device may be more miniaturized, compared to the handle which is entirely made of metal and has separate parts performing rotation and connection functions.

In addition, in the present disclosure, the handle body may be located inside the handle which a user grips. The handle body may be made of synthetic resin. When a user grips the handle, the handle body made of synthetic resin may transmit less coldness to the user than a handle body made of metal, thereby improving gripping feeling and usability.

Furthermore, the handle body and the handle cover constituting the door opening device of the present disclosure may be assembled with each other by a hook structure without a separate fastener or adhesive. Particularly, when the handle cover is rotated with a side of the handle cover held in the handle body, the handle body and the handle cover may be assembled with each other. Accordingly, the assemblability of the door opening device may be improved.

Additionally, in the door opening device of the present disclosure, when the handle is located at an initial position thereof, a surface of the push rod may be in contact with the driving arm of the handle cover, and may be in surface contact with and be supported by the link block configured to rotate. Accordingly, the push rod which is a part performing a rectilinear reciprocating motion may be in surface contact with and be supported by two other parts in the initial position of the push rod, so noise occurring due to the shaking of the push rod may be prevented, and thus the quality of the door opening device may be improved.

In addition, in the present disclosure, the handle cover may have the same cross-sectional shape along a longitudinal direction thereof and thus may be easily manufactured by extruding. Each of the open opposite ends of the handle cover may be covered by the link connection part of the handle body. Accordingly, in the present disclosure, to shield the open part of the handle cover, a separated part may not be required, and a part configured to receive the link block may naturally shield the handle cover by being assembled therewith, so the number of parts and assembly work may be reduced, and due to the reduced number of the parts, the unity of the exterior of the door opening device may be further improved.

Furthermore, in the present disclosure, parts for rotating the handle such as the link block and the bracket rotation part may be received in the link connection part of the handle body. Accordingly, even without being covered by a separate cover, the exposure of the parts related to the rotation to the outside may be minimized, and the link connection part may function to cover and protect the parts for the rotation, thereby further improving the durability of the parts.

Additionally, in the present disclosure, the link block may be connected rotatably to the fixed guide bracket, so the handle may be rotated. In this case, two stoppers may be provided between the link block and the guide bracket and may limit the rotation of the link block. Accordingly, resistance (impact amount) for limiting the rotation of the link block may also be distributed to two stoppers, which may increase the durability of the door opening device.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Figure 1:
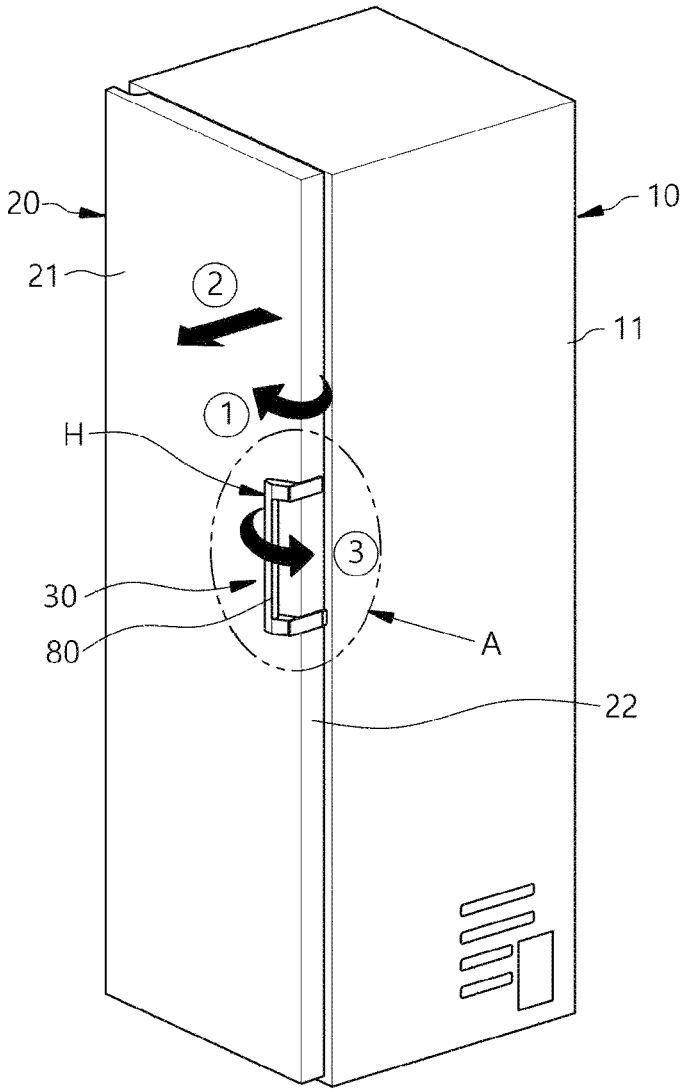
FIG. 1 is a perspective view illustrating configuration of a refrigerator in which an embodiment of a door opening device of the present disclosure is applied.

In the door opening device 30 of the present disclosure, when a handle assembly H is rotated, a push rod 50 may protrude and push a cabinet 11 of the refrigerator. Accordingly, the door opening device 30 may convert rotational motion into rectilinear motion, allowing a user to open a refrigerator door with a relatively small force. The push rod 50 may naturally be protruded only by pulling the handle to open the door.

In the door opening device 30 of the present disclosure, a handle cover 80 which is a part pushing the push rod 50 may be made of metal and may constitute the front surface of the handle assembly H. That is, the part constituting the exterior of the handle assembly H may directly push the push rod 50. Such a door opening device 30 may be applied to doors of home appliances such as a refrigerator, a freezer, a kimchi refrigerator, a plant cultivation device, a styler, and a washer, and further, may be applied to the door of a freezer warehouse installed in a building. Hereinafter, as an example, the door opening device 30 of the present disclosure applied to the refrigerator 10 will be described.

Referring to FIG. 1, the cabinet 11 may constitute the exterior of the refrigerator 10, and may be configured as a casing open forward. The cabinet 11 may have an approximately rectangular parallelepiped shape having height higher than width. Of course, the shape of the cabinet 11 may be just one example and may be changed to various shapes.

Although not shown, the cabinet 11 may include a machine room provided at the lower part thereof, and an air conditioning system may be installed in the machine room. The air conditioning system may be intended to control the temperature of a storage room 12 provided inside the cabinet 11. The air conditioning system may include a compressor, a condenser, and an evaporator. The temperature of air circulating in the storage room may be controlled by such an air conditioner.

Figure 2:
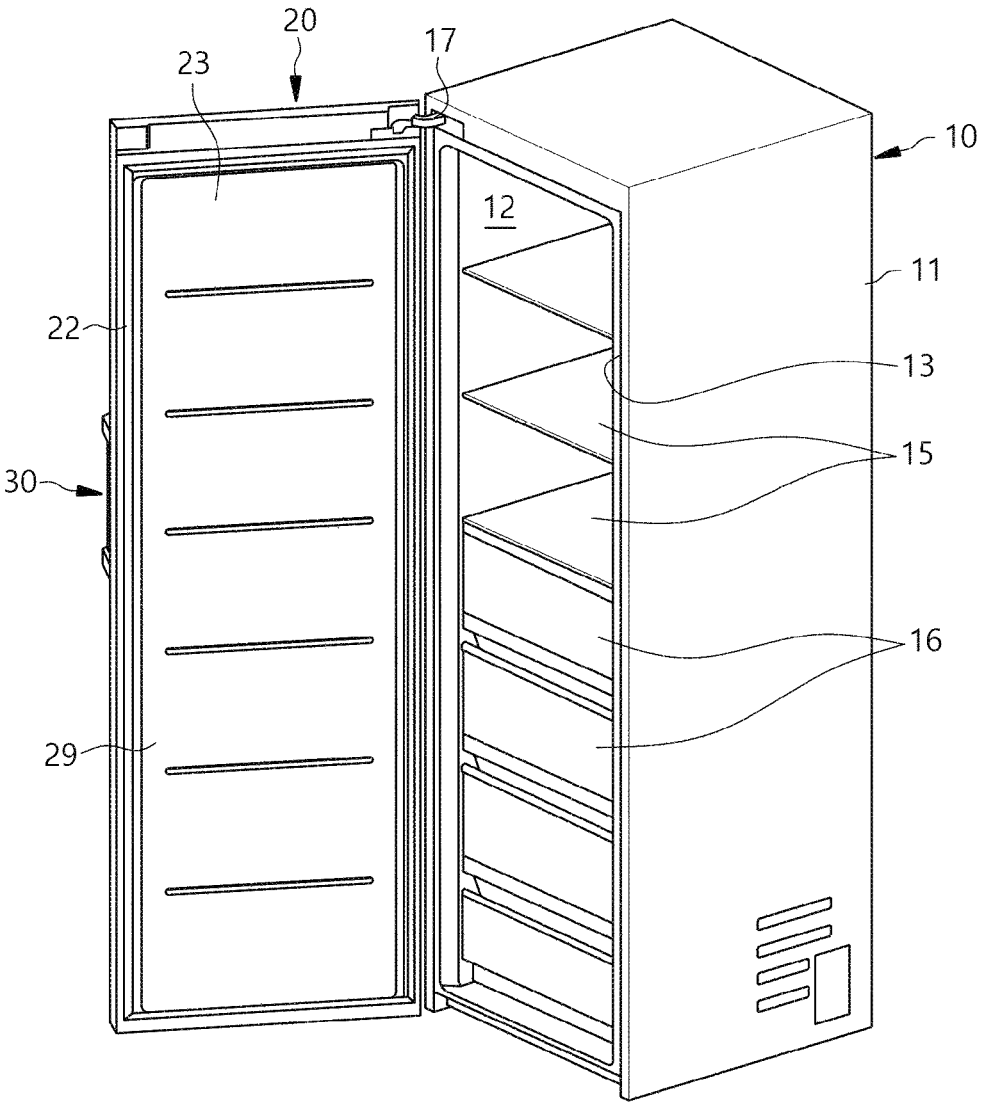
FIG. 2 is a perspective view illustrating an opened state of a refrigerator door of FIG. 1.

The storage room 12 which is empty space may be provided in the cabinet 11. Referring to FIG. 2, the storage room 12 may be divided into multiple spaces by several layered shelves 15. Additionally, a separate storage box 16 may be provided under the storage room 12.

The storage room 12 of the cabinet 11 may be selectively shielded by a door assembly 20 to be described later. When the door assembly 20 is in close contact with the front surface 13 of the cabinet 11, the storage room 12 may be shielded. To rotate the door assembly 20, hinges 17 may be installed on the front surface 13 of the cabinet 11, and the door assembly 20 may be connected rotatably to the hinges 17.

The door assembly 20 may have a shape corresponding to the shape of the front surface 13 of the cabinet 11, and may have the structure of an approximately flat plate. The door assembly 20 may function to open and close the storage room 12 while rotating relative to the hinges. FIG. 1 illustrates the closed state of the door assembly 20, and FIG. 2 illustrates the opened state of the door assembly 20. The front surface 21 of the door assembly 20 may be a surface facing a user, and a rear surface 23 of the door assembly 20 may be a surface facing the storage room 12. The rear surface 23 of the door assembly 20 may be in close contact with the front surface 13 of the cabinet 11 at an edge of the rear surface 23.

Accordingly, the door assembly 20 may open the storage room 12 by rotating. In this case, a user may pull the door opening device 30 installed on the door assembly 20. The door opening device 30 may be installed on a side surface of the door assembly 20, and may be a part which a user grips to rotate the door assembly 20.

Referring to FIG. 1, the door assembly 20 may open by rotating in direction of an arrow ①. To this end, a user may grasp the handle assembly H of the door opening device 30 and pull the handle assembly H in direction of an arrow ②. In this case, the handle assembly H may first be rotated relative to a rotating shaft P to be described below, and an arrow ③ indicates the rotating direction of the handle assembly H. In this process, the push rod 50 to be described later may protrude and may push a front surface 13 of the cabinet 11. For reference, the handle assembly H may include a handle body 70 and the handle cover 80 to be described later.

Figure 11:
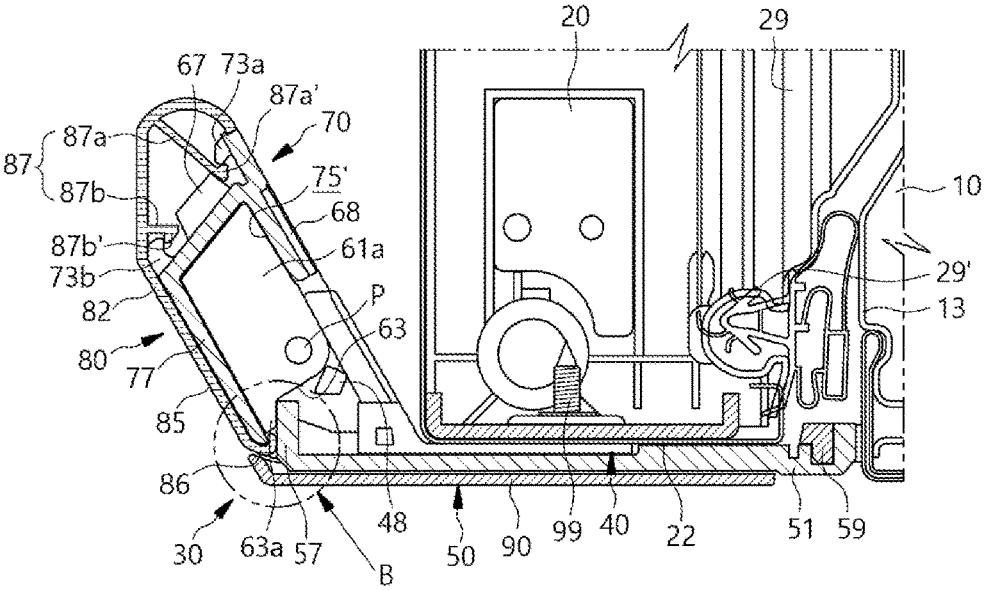
FIG. 11 is a cross-sectional view taken along line I-I' of FIG. 8.

A gasket 29 may be installed at a rear surface 23 of the door assembly 20. The gasket 29 may be intended to allow the door assembly 20 and the cabinet 11 to be sealed without a gap therebetween, and may have a magnet embedded therein. The door assembly 20 and the cabinet 11 may be in close contact with each other by the magnet. However, due to the magnetic force of the magnet and negative pressure inside the storage room 12, force required to separate the door assembly 20 from the cabinet 11 may increase. The door opening device 30 of the embodiment may allow initial force required to open the door assembly 20 to be reduced. In FIG. 11, a gasket fixer 29' for fixing the gasket 29 is illustrated.

Figure 3:
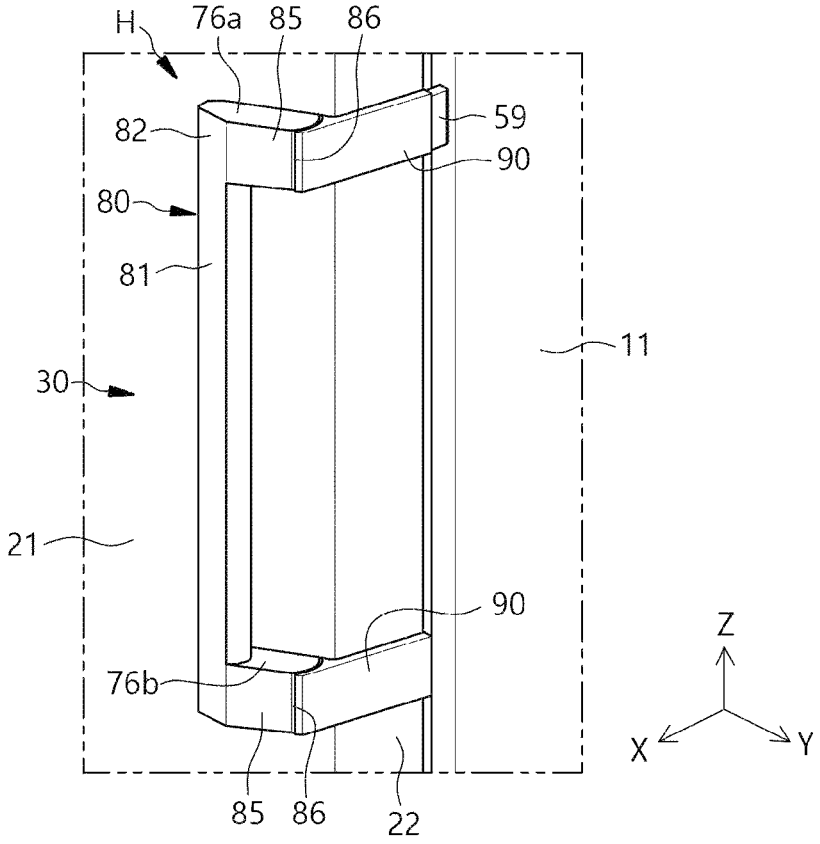
FIG. 3 is a perspective view illustrating the embodiment of the door opening device of the present disclosure.

Referring to FIG. 3 in which the A part of FIG. 1 is enlarged, the door opening device 30 of the embodiment may have an approximately U-shaped exterior. The handle assembly H constituting the door opening device 30 may have an approximately U shape, and a bracket cover 90 covering a guide bracket 40 to be described later may be connected to the handle assembly H, so the entire shape of the handle assembly H may have an approximate U shape.

The handle assembly H constituting the door opening device 30 may be a part exposed to the outside, and may include the handle body 70 and the handle cover 80 to be described later. The handle body 70 and the handle cover 80 may be assembled with each other and may constitute the handle assembly H which a user grips. As illustrated in FIG. 3, most of the parts directed toward a user may be configured as the handle cover 80, and only a portion of each of the upper and lower ends of the handle body 70 may be covered by an outer plate 76*a* and an inner plate 76*b* of the handle body 70. Accordingly, most of the exposed parts may be configured as the handle cover 80 made of metal, which may look unified and luxuriously beautiful to a user.

Figure 4:
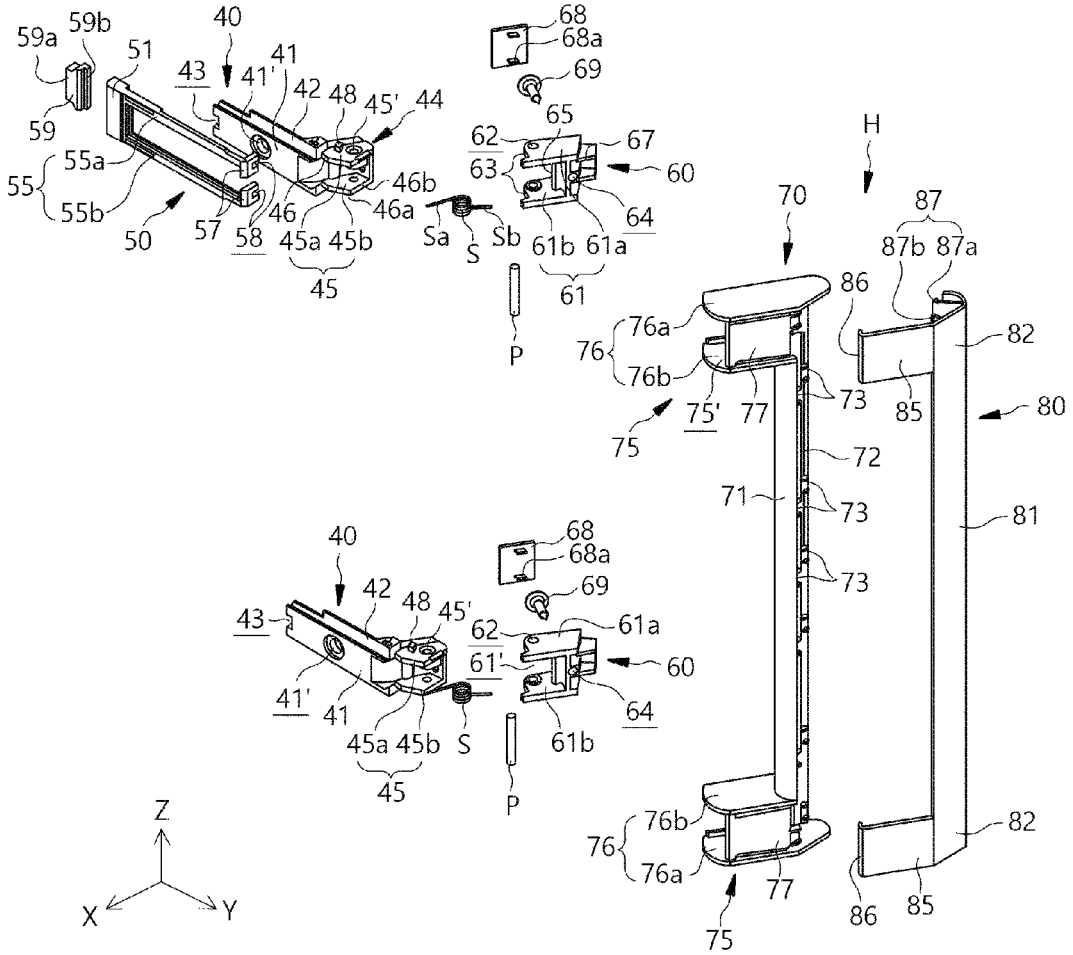
FIG. 4 is an exploded perspective view of components constituting the door opening device according to the embodiment of the present disclosure.
Figure 5:
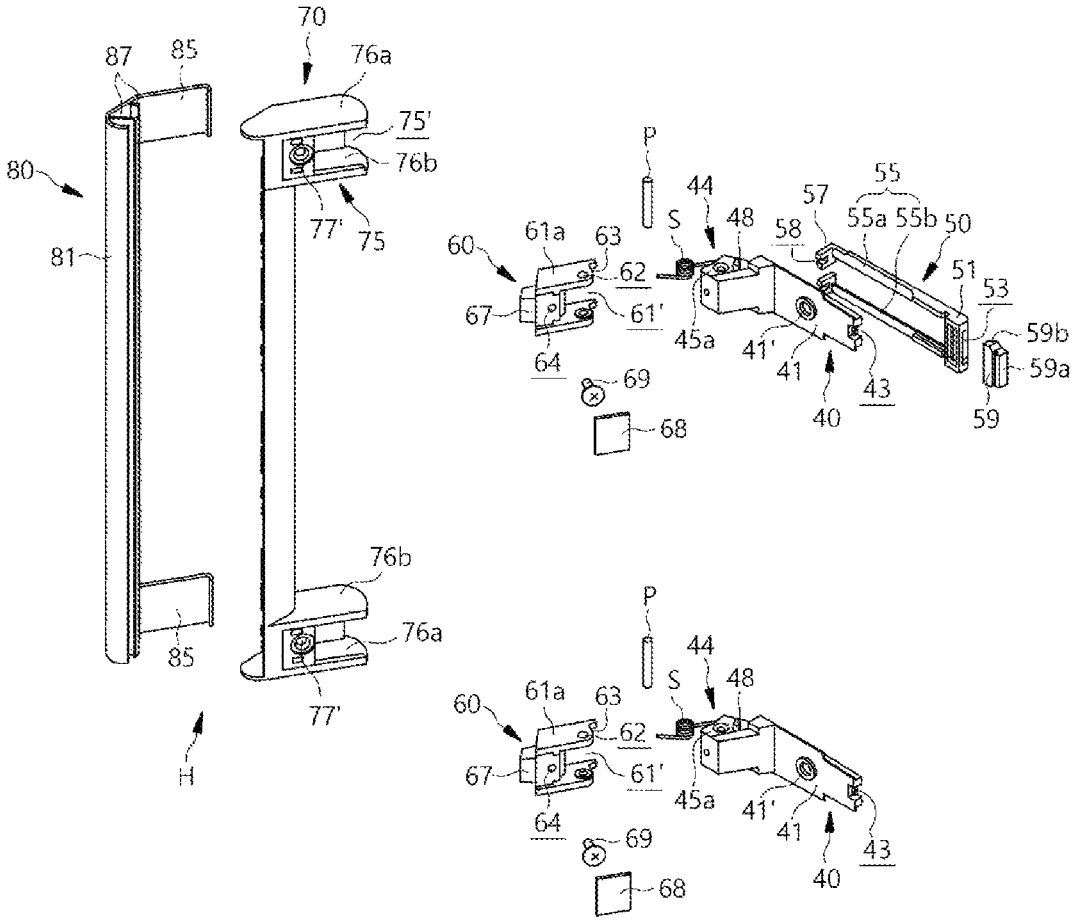
FIG. 5 is an exploded perspective view of the components of the door opening device seen from an angle different from FIG. 4 according to the embodiment of the present disclosure.

In FIGS. 4 and 5, the exploded perspective views of parts constituting the door opening device 30 according to the embodiment are illustrated. First, as for the guide bracket 40 fixed to the side surface of the door assembly 20 in the parts constituting the door opening device 30, the guide bracket 40 may function (i) to guide a rectilinear reciprocating motion of the push rod 50, and (ii) may be a part connected to a link block 60 and the handle body 70 such that link block 60 and the handle body 70 are rotated. That is, the push rod 50, and the link block 60 and the handle body 70 may perform a rectilinear motion and a rotational motion, respectively. The guide bracket 40 may be fixed to the door assembly 20 and may be considered as a part supporting the push rod 50, the link block 60, and the handle body 70 such that the push rod 50, and the link block 60 and the handle body 70 may perform the rectilinear motion and the rotational motion, respectively.

The frame of the guide bracket 40 may be constituted by a bracket body 41 having an approximate flat plate shape. The bracket body 41 may be made of synthetic resin or may be made of a different material by insert-injecting metal into the bracket body. For example, the guide bracket 40 may fixed to the door assembly 20 by a bolt, and the periphery of a bracket hole 41*a* to which the bolt is fastened may be made of the insert-injected metal, which may reinforce the strength of the guide bracket.

A guide part 42 may be provided at the bracket body 41. The guide part 42 may guide the movement of the push rod 50. In the embodiment, the guide part 42 may be configured to include guide parts stepped from a surface of the bracket body 41. The guide parts 42 may extend parallel to each other at the surface of the bracket body 41 to form a pair of step structures. With two guide legs 55 of the push rod 50 engaged with the guide parts 42 having step shapes, the push rod 50 may move. Accordingly, the push rod 50 may rectilinearly move along the longitudinal direction of each of the guide parts 42. The guide part 42 may be configured as a part separate from the bracket body 41, or may be a structure recessed inward from the bracket body 41 or protruded outward therefrom instead of the step shape.

A fastening groove 43 may be formed in the bracket body 41. The fastening groove 43 may be intended to couple the bracket body 41 to the bracket cover 90 to be described later. Although not shown, a fastening hook provided in the bracket cover 90 may be held in the fastening groove 43. In the embodiment, the fastening groove 43 may have a shape recessed from an end of the bracket body 41. The fastening groove 43 may be located at an end opposite to the end of the bracket body 41 or at a side surface of the bracket body 41. In a case in which the bracket cover 90 is assembled with the bracket body 41 by a separate bolt or adhesive, the fastening groove 43 may be omitted. For reference, reference numeral 99 of FIG. 11 indicates a fastener fixing the bracket body 41 to the door assembly 20.

A bracket rotation part 44 may be provided at the bracket body 41. The bracket rotation part 44 may be provided at a side of the bracket body 41, and more specifically, may be provided at an end of the bracket body 41 in a direction opposite to the protruding direction of the push rod 50. The bracket rotation part 44 may be coupled to the link block 60 to be described later such that the bracket rotation part 44 rotates relative to the link block 60, so the link block 60 may rotate relative to the bracket rotation part 44. In the embodiment, the bracket rotation part 44 may be provided to be integrated with the bracket body 41, but may be a part separate therefrom.

The bracket rotation part 44 may include a rotating plate unit 45 having a pair of rotating plates 45*a* and 45*b* spaced apart from each other. The rotating plate unit 45 may be configured as the pair of rotating plates located at heights different from each other along the longitudinal direction of the handle assembly H. Here, the longitudinal direction of the handle assembly H may be the height direction of the handle body 70 constituting the handle assembly H. As illustrated in FIG. 4, the longitudinal direction of the handle body 70 may be the same as a Z axis direction.

A first shaft hole 45' may be formed through the pair of rotating plates 45*a* and 45*b*. The first shaft hole 45' may be a part to which the rotating shaft P is inserted, and may be located at a position corresponding to a second shaft hole 62 of the link block 60 to be described later. Accordingly, the rotating shaft P may pass through each of the first shaft hole 45' and the second shaft hole 62.

Predetermined space may be provided between the pair of rotating plates 45*a* and 45*b*, and a return spring S may be located in the space. The return spring S may be installed between the pair of rotating plates 45*a* and 45*b*, and may supply elastic force to the guide bracket 40 and the link block 60 such that the guide bracket 40 and the link block 60 rotate relative to each other. More specifically, in the embodiment, the guide bracket 40 may be fixed to the door assembly 20, and thus the return spring S may supply rotational force to the link block 60 in a direction of moving the link block 60 to an initial position thereof.

In the embodiment, the return spring S may be configured as a torsion spring fitted over the rotating shaft P. The opposite ends Sa and Sb of the return spring S may be supported by the bracket rotation part 44 and the link block 60, respectively. Accordingly, during the rotation of the link block 60, the return spring S may accumulate elastic energy, and when the external force that rotates the link block 60 is removed, the link block 60 may be moved to an initial position thereof by the accumulated elastic energy. In this process, the handle assembly H coupled to the link block 60 may also rotate therewith. The return spring S may not be necessarily limited to the torsion spring, and may be configured as various springs such as a coil spring, a plate spring, or a volute spring.

Figure 6:
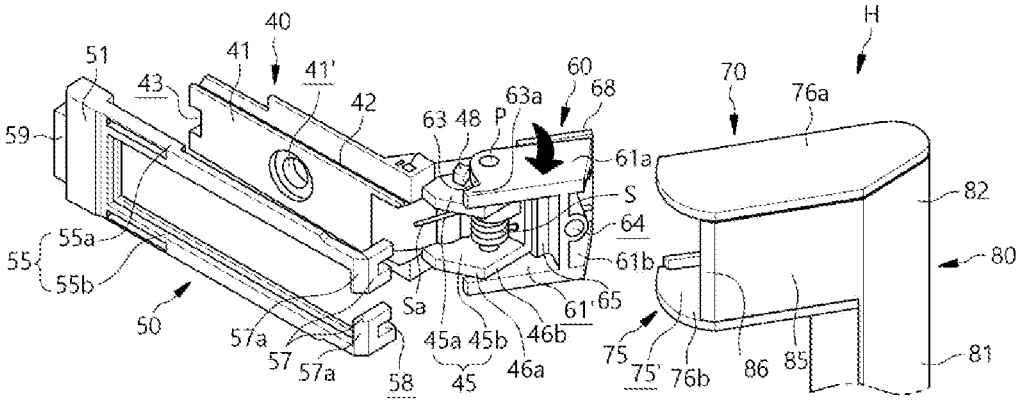
FIG. 6 is a perspective view illustrating the coupled state of a guide bracket and a link block constituting the door opening device to each other according to the embodiment of the present disclosure.

Meanwhile, the side surfaces 46 of the pair of rotating plates 45*a* and 45*b* may perform the stopping function of limiting the movement of the push rod 50 and the rotation of the link block 60. As illustrated in FIG. 6, the side surface 46 of each of the rotating plates 45*a* and 45*b* may be a surface formed along an outer edge of the rotating plate unit 45. The side surface 46 of the rotating plate unit 45 may be divided into a first side surface 46*a* and a second side surface 46*b*. The first side surface 46*a* and the second side surface 46*b* may be connected to each other with predetermined angle therebetween.

Here, a guide groove 58 of the push rod 50 to be described below may be fitted over the first side surface 46*a*. More specifically, the guide groove 58 may be formed in a pressed part 57 of the push rod 50 by being recessed therefrom, and the push rod 50 may move with the guide groove 58 fitted over the first side surface 46*a*. In this case, the guide leg 55 constituting the push rod 50 may not be separated from the first side surface 46*a* in directions orthogonal to the moving directions of the push rod 50 (in a vertical direction relative to FIG. 6), and may move along a predetermined course during the movement of the push rod 50.

A portion of the link block 60 may touch the second side surface 46*b*, so the rotation angle of the link block 60 may be limited. During the rotation of the link block 60, a stopping rib 65 of the link block 60 to be described later may interfere with the second side surface 46*b*. When the stopping rib 65 touches the second side surface 46*b*, the link block 60 may not rotate any longer. Accordingly, the second side surface 46*b* and the stopping rib 65 may function as a first stopper of the link block 60.

Meanwhile, a bracket stopper 48 may protrude from the surface of the rotating plate unit 45. The bracket stopper 48 may be made to have a shape protruding from the surface of the rotating plate unit 45. During the rotation of the link block 60, the bracket stopper 48 may interfere with the link block 60, and may function to limit the rotation of the link block 60. More specifically, when a stopping surface 63 of the link block 60 is in contact with the bracket stopper 48, the link block 60 may not rotate any longer. Accordingly, the bracket stopper 48 and the stopping surface 63 of the link block 60 may function as a second stopper of the link block 60.

In this case, a part performing the stopping function may be divided into parts, and thus force limiting the rotation of the link block 60 may be distributed, so the durability of the door opening device 30 may be increased. Of course, one of the first stopper and the second stopper may be omitted. For reference, in FIG. 6, the stopping rib 65 of the link block 60 is not in contact with the second side surface 46*b*, and the stopping surface 63 of the link block 60 is not in contact with the bracket stopper 48. Accordingly, in the state of the link block 60 in FIG. 6, the link block 60 may rotate in a direction of an arrow.

Next, as for the push rod 50, the push rod 50 may selectively push the front surface 13 of the cabinet 11 while performing the rectilinear reciprocating motion. To this end, the push rod 50 may not fixed but may move along the guide parts 42 of the guide bracket 40. The push rod 50 may be made of non-metal or metal, or may be made of synthetic resin in the embodiment.

Referring back to FIG. 4, the push rod 50 may be a structure having an approximate U shape. A push head 51 configured to push the front surface 13 of the cabinet 11 at which the door assembly 20 is installed may be provided in the push rod 50. The push head 51 may be arranged at an end part of the push rod 50 directed toward the front surface 13 of the cabinet 11. The push head 51 may directly push the front surface 13 of the cabinet 11, but a separate push block 59 may be provided at the push head 51 to prevent damage thereto.

In the embodiment, the push block 59 may be made of rubber and be fitted to the push head 51. Referring to FIG. 5, a block insertion hole 53 may be formed in the push head 51, and a fastening part 59*b* which is a part of the push block 59 may be fitted to the block insertion hole 53. Additionally, a push part 59*a* of the push block 59 may protrude toward the outside of the block insertion hole 53 and may be a part configured to be in contact with the front surface 13 of the cabinet 11.

The guide leg 55 may extend from the push head 51. The guide leg 55 may have a shape of a long rod, and may extend from the push head 51 toward a driving arm 85 of the handle cover 80 such that the guide leg 55 has a cantilever shape. In the embodiment, the guide leg 55 may include a pair of guide legs connected to the guide parts 42 of the guide bracket 40. The pair of guide legs 55 may perform a rectilinear reciprocating motion while being guided by the guide parts 42. The pair of guide legs 55 may be divided into a first leg 55*a* and a second leg 55*b*. In the embodiment, the first leg 55*a* and the second leg 55*b* have the same lengths and may be located at heights different from each other relative to the longitudinal direction of the handle body 70 (a z axis direction of FIG. 4).

Referring to FIG. 6, the pressed part 57 pressed by the driving arm 85 of the handle cover 80 may be provided at the end of each of the pair of guide legs 55. In order to increase an area in which the pressed part 57 is in contact with the driving arm 85, the pressed part 57 may extend in a direction orthogonal to the extending direction of the guide leg 55 from the push head 51. Furthermore, at least a portion of a surface of the driving arm 85 may be configured as an inclined surface 57*a*, so the pressed part 57 may be prevented from being worn by sharp edges while being pushed by the driving arm 85.

The guide groove 58 may be formed in an end part of the pressed part 57. The guide groove 58 may be fitted over the bracket rotation part 44 of the guide bracket 40 described above. More specifically, the guide groove 58 of the push rod 50 may be fitted over the first side surface 46*a* of the rotating plate unit 45 of the bracket rotation part 44, and with the guide groove 58 fitted over the first side surface 46*a*, the push rod 50 may operate. In this case, during the operation of the push rod 50, the guide leg 55 may move along the first side surface 46*a*. In other words, the moving distance of the push rod 50 may be considered to be the same as the length of the first side surface 46*a*.

In the embodiment, the pair of guide legs 55 may have ends separated from each other at a side thereof. Accordingly, the ends of the pair of guide legs 55 may be apart from each other. When the first leg 55*a* and the second leg 55*b* constituting the guide leg 55 are spaced apart from each other, a distance therebetween may increase, so the guide leg 55 may easily be fitted over the guide part 42 of the guide bracket 40. Of course, the ends of the pair of guide legs 55 may be made to be connected to each other.

Figure 7A:
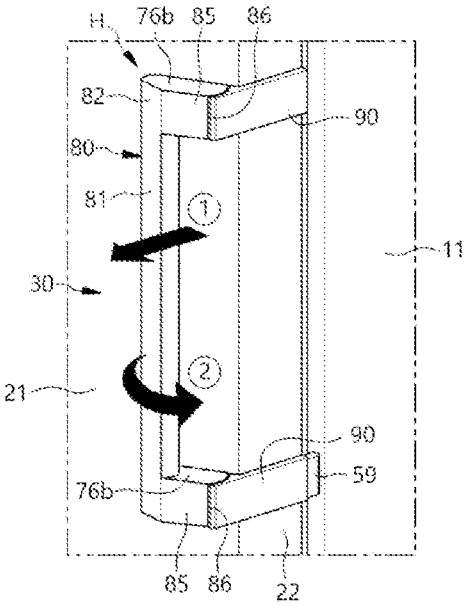
FIGS. 7A and 7B are operation state views illustrating a handle assembly before and after the rotation thereof, respectively, according to the embodiment of the present disclosure.
Figure 7B:
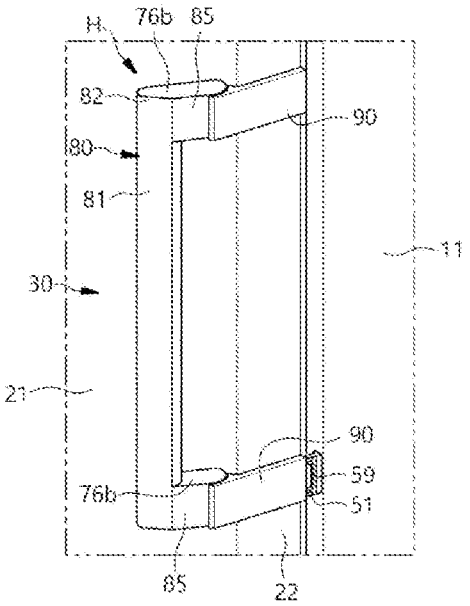

Such a push rod 50 may be installed on at least one of the upper and lower parts of the door opening device 30. As illustrated in FIGS. 4 and 5, the push rod 50 may be installed only on the upper side of the door opening device 30. Alternatively, as illustrated in FIGS. 7A and 7B, the push rod 50 may be installed only on the lower side of the door opening device 30. Of course, the push rod 50 may be installed on both the upper and lower parts of the door opening device 30.

Next, the link block 60 will be described hereinafter. The link block 60 may be a part connecting the guide bracket 40 to the handle body 70. In this case, the link block 60 may be connected rotatably to the guide bracket 40, but may be fixed to the handle body 70, so the link block 60 may rotate with the handle body 70. The link block 60 may be made of synthetic resin by being injection-molded.

Referring to FIGS. 4 and 5, a link plate unit 61 coupled to the bracket rotation part 44 of the guide bracket 40 may be provided in the link block 60. The link plate unit 61 may be superimposed on the rotating plate unit 45 constituting the bracket rotation part 44, and may be composed of a pair of first link plate 61*a* and second link plate 61*b* as the rotating plate unit 45 is composed of a pair of rotating plates. The link plate unit 61 may be composed of the first link plate 61*a* and the second link plate 61*b* spaced apart from each other, and rotation space 61' which is predetermined empty space may be defined therebetween. As illustrated in FIG. 6, the bracket rotation part 44 may be inserted to the rotation space 61', and the return spring S may also be located in the rotation space 61'.

The second shaft hole 62 may be formed through each of the pair of link plates 61*a* and 61*b*. The second shaft hole 62 may be formed at a position corresponding to the first shaft hole 45' of the rotating plate unit 45. The rotating shaft P may pass through each of the first shaft hole 45' and the second shaft hole 62. When the rotating shaft P passes through the first shaft hole 45' and the second shaft hole 62, the rotating shaft P may be a rotation center when the link block 60 rotates relative to the bracket rotation part 44.

The stopping surface 63 may be formed on a side surface of the link block 60. The stopping surface 63 may be a surface formed along a side surface of each of the pair of link plates 61*a* and 61*b* constituting the link block 60, and may interfere with the bracket stopper 48. More specifically, during the rotation of the link block 60, the bracket stopper 48 (the second stopper) may interfere with the stopping surface 63 of the link block 60 and may limit the rotation of the link block 60. The stopping surface 63 may be configured as a flat surface to be in surface contact with the bracket stopper 48.

In this case, the stopping surface 63 may have a support part 63*a* protruding from a side thereof. Referring to FIG. 6, the support part 63*a* may protrude from a position beyond the stopping surface 63 interfering with the bracket stopper 48 in a direction of increasing a width of the link plate unit 61. In the initial position of the handle body 70, the support part 63*a* may be in surface contact with the surface of the pressed part 57 of the push rod 50 and may support the pressed part 57.

Figure 12:
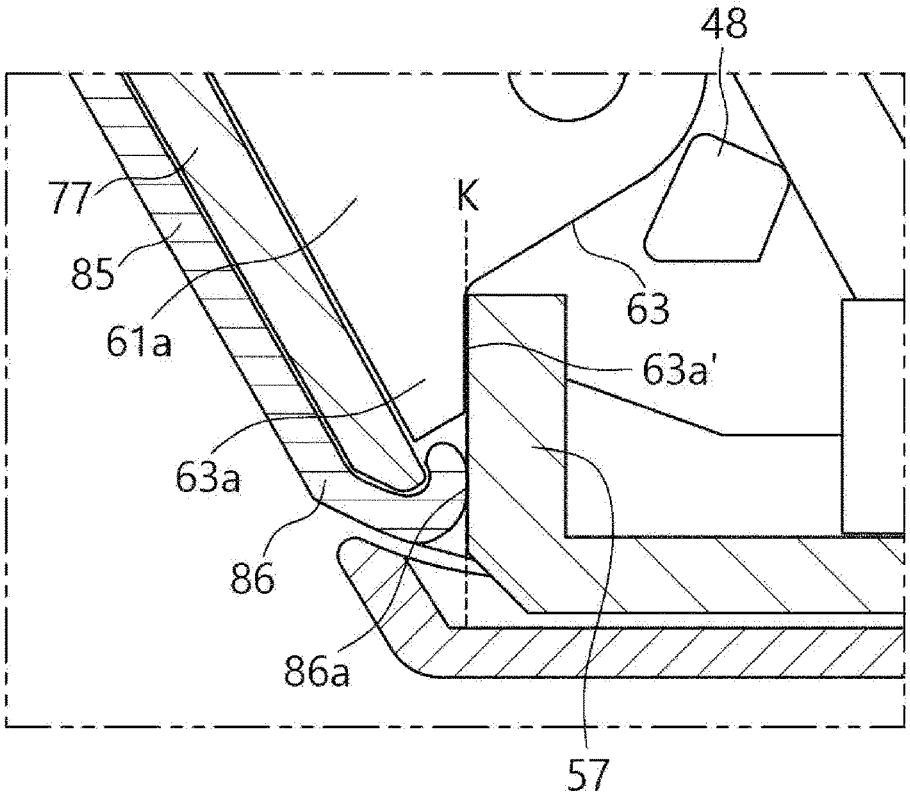
FIG. 12 is the enlarged cross-sectional view of B part of FIG. 11.

Referring to FIG. 12, in the initial position of the handle assembly H prior to the rotation thereof, a surface 63*a'* of the support part 63*a* may be in surface contact with the surface of the pressed part 57 of the push rod 50, so the support part 63*a* may support the pressed part 57. Referring to FIG. 12, the push rod 50 may perform the rectilinear reciprocating motion in a horizontal direction, and the support part 63*a* may press a side of the pressed part 57, so the shaking and noise of the push rod 50 may be prevented.

In this case, in the embodiment, the driving arm 85 constituting the handle cover 80 may be in surface contact with the same surface as the surface of the pressed part 57. The surface 86*a* of a guide hook 86 which is the end part of the driving arm 85 of the handle cover 80, with the surface 63*a'* of the support part 63*a*, may support the same surface of the pressed part 57. Accordingly, as illustrated in FIG. 12, the support part 63*a* and the driving arm 85 may be located on the same line K. Accordingly, the support part 63*a* and the driving arm 85 may support the push rod 50, so the shaking of the push rod 50 may be more reliably prevented.

Referring back to FIG. 4, a block fastening hole 64 may be formed in the link block 60. The block fastening hole 64 may be empty space defined by passing through the link block 60 in a direction orthogonal to the rotating shaft P, and may allow the link block 60 to be fastened to the handle body 70. That is, when the fastener 69 such as a bolt passes through the block fastening hole 64 and is fastened to the handle body 70, the link block 60 may be fastened to the handle body 70.

In the embodiment, a shielding plate 68 may be coupled to the link block 60, and may cover the entrance of the block fastening hole 64 located at the outside thereof and the periphery of the fastener 69. A fixing hook 68*a* may protrude from the shielding plate 68 and may be held in and fixed to the link block 60. In FIG. 6, the shielding plate 68 is illustrated to be assembled with the link block 60.

The stopping rib 65 may be provided in the link block 60. The stopping rib 65 may be in contact with the second side surface 46*b* of the rotating plate unit 45 and may function as the first stopper limiting the rotation angle of the link block 60. The stopping rib 65 may extend in a direction parallel to the rotating shaft P of the link block 60. In the embodiment, the opposite ends of the stopping rib 65 may be connected to the pair of rotating plates 45*a* and 45*b*, respectively. Accordingly, during the rotation of the link block 60, the stopping rib 65 may interfere with two second side surfaces 46*b* of the pair of rotating plates 45*a* and 45*b* of the bracket rotation part 44.

Meanwhile, a support body 67 may protrude from the link block 60. The support body 67 may protrude from the link block 60 toward a link connection part 75 of the handle body 70. More specifically, as illustrated in FIG. 11, when the link block 60 is assembled with the handle body 70, the support body 67 may protrude toward the handle cover 80 through a through hole of the handle body 70. Additionally, a part of the support body 67 protruding in a direction toward the handle cover 80 may support a main hook 87 of the handle cover 80 to be described later, and may prevent distance between two hooks of the main hook 87 from increasing. Accordingly, a state in which the main hook 87 is held in the assembly jaw 73 of the handle body 70 may be maintained.

In the embodiment, the support body 67 may be located between a first hook 87*a* and a second hook 87*b* constituting the main hook 87. In this case, the support body 67 may support both the first hook 87*a* and the second hook 87*b*, and thus the first hook 87*a* and the second hook 87*b* may be elastically transformed in narrowing directions therebetween and may be prevented from being removed from the first assembly jaw 73*a* and the second assembly jaw 73*b*, respectively.

In the embodiment, while the handle body 70 and the handle cover 80 constituting the handle assembly H are assembled with each other, the assembly of the link block 60 and the guide bracket 40 may be fitted to the handle assembly H. In this process, the support body 67 of the link block 60 may be naturally inserted to the handle cover 80 through the through hole of the handle body 70. Accordingly, the support body 67 may not prevent the assembling of the handle body 70 and the handle cover 80, and may support both the first hook 87*a* and the second hook 87*b* such that a state in which the handle body 70 and the handle cover 80 are assembled with each other is maintained. Of course, the support body 67 may support only one of the first hook 87*a* and the second hook 87*b*. The support body 67 may be omitted in the link block 60.

Next, the handle assembly H will be described. The handle assembly H may be a part that a user grips when opening and closing the door assembly 20. The handle assembly H may be made to have a U shape such that a user easily grips the handle assembly H, and may extend long along the height direction of the cabinet 11. Accordingly, in the embodiment, the longitudinal direction of the handle assembly H may be the height direction of the cabinet 11.

The handle assembly H may be coupled to the link block 60 and, with the link block 60, may rotate relative to the guide bracket 40. Referring to FIG. 7A, when the entirety of the door opening device 30 is pulled in a direction toward a user (in a direction of arrow ①) while a user grips the handle assembly H, the handle assembly H may rotate counterclockwise (in a direction of arrow ①). Furthermore, the rotated state of the handle assembly H is illustrated in FIG. 7B. In this case, the push rod 50 may protrude by operating in cooperation with the rotation of the handle assembly H, and in FIG. 7B, the push block 59 of the push rod 50 is illustrated to protrude.

The handle assembly H may include the handle body 70 and the handle cover 80. The handle body 70 may be coupled to the link block 60. The handle assembly H, with the link block 60, may rotate relative to the guide bracket 40. Additionally, the handle cover 80 may be coupled to the handle body 70, and may constitute at least a portion of a surface of the handle body 70. The handle cover 80 may have the driving arm 85 configured to push the push rod 50 while the driving arm 85 rotates with the handle body 70.

Accordingly, in the handle assembly H according to the embodiment, (i) a complex structure such as a connection structure for rotating the handle assembly H may be constituted by the handle body 70, and (ii) a simple structure for opening the door assembly 20 by pushing the push rod 50 may be constituted by the handle cover 80. In this case, the handle assembly H may be manufactured by being injection molded and thus may have a complex shape. The handle cover 80 may have a simple structure and thus may be made by extruding a metal material such as aluminum.

As illustrated in FIG. 3, the front surface of the door opening device 30, that is, most of the parts exposed in the direction toward a user may be the handle cover 80. It is because when the handle cover 80 is assembled with the handle body 70, the handle cover 80 may cover the front surface of the door opening device 30. The horizontal plate 76 of the handle body 70 may be exposed to the outside only in a very small area at each of the top and bottom of the handle assembly H, and the bracket cover 90 may be arranged on a side surface of the handle assembly H and thus may have a small area exposed toward a user. Accordingly, most of the exposed portions may be configured as the handle cover 80 made of metal, which may look unified and luxuriously beautiful to a user.

The handle assembly H will be described in detail hereinafter. First, the handle body 70 may include: a handlebar 71 extending long in one direction; and the link connection part 75 extending from each of the opposite ends of the handlebar 71. Here, the handlebar 71 may be a part which a user mostly grips. The link connection part 75 may extend in a direction different from the longitudinal direction of the handlebar 71 and may be coupled to the link block 60 so as to function as a connection part.

The handlebar 71 may have the shape of a rod that extends long in one direction. In the embodiment, a surface of a portion of the handlebar 71 may be a curved surface. When a portion of the surface of the handlebar 71 is configured as the curved surface, feel to a user may be improved when the user grips the curved surface. Alternatively, the surface of the handlebar 71 may be configured only as a flat surface.

Referring to FIG. 4, the assembly jaw 73 may be provided in the handlebar 71. The assembly jaw 73 may be provided on an assembly surface 72 of the handlebar 71, and the assembly surface 72 may be a part covered by the handle cover 80. The assembly hook 87 of the handle cover 80 to be described later may be held in the assembly jaw 73, so the handle body 70 and the handle cover 80 may be assembled with each other.

The assembly jaw 73 may include multiple assembly jaws arranged along the longitudinal direction of the handlebar 71. Relative to FIG. 4, the multiple assembly jaws 73 may be provided at heights different from each other on the assembly surface 72. Accordingly, in the embodiment, the multiple assembly jaws 73 may be provided by being separated from each other, whereas each of the assembly hooks 86 and 87 of the handle cover 80 may be formed by extending long in one direction without being separated.

Referring to FIG. 11, the assembly hook 87 is illustrated to be held in the assembly jaw 73. As illustrated in FIG. 11, the assembly jaw 73 may include the first assembly jaw 73*a* and the second assembly jaw 73*b*. The first hook 87*a* of the assembly hooks 86 and 87 to be described later may be held in the first assembly jaw 73*a*, and the second hook 87*b* may be held in the second assembly jaw 73*b*.

In this case, the first assembly jaw 73*a* and the second assembly jaw 73*b* may protrude in directions opposing each other. More specifically, the first assembly jaw 73*a* and the second assembly jaw 73*b* may protrude in directions facing each other, and may be held in the hook ends 87*a*' and 87*b*', respectively, formed at the ends of the first hook 87*a* and the second hook 87*b*, respectively, such that the first assembly jaw 73*a* and the second assembly jaw 73*b* face the hook ends 87*a*' and 87*b*', respectively. Accordingly, the first hook 87*a* and the second hook 87*b* may be held in the first assembly jaw 73*a* and the second assembly jaw 73*b*, respectively, in opposite directions, so the assembly of the handle body 70 with the handle cover 80 may be maintained to be more stable.

Referring back to FIG. 4, the link connection part 75 may be provided in the handle body 70. The link connection part 75 may extend in a direction orthogonal to the handlebar 71. In the embodiment, the link connection part 75 may be provided at the upper and lower ends of the handlebar 71, respectively. Alternatively, the link connection part 75 may be provided at a side inner than the end of the handle body 70.

The link connection part 75 may be coupled to the link block 60 described above. In addition, a portion of the bracket rotation part 44 connected rotatably to the link block 60 may be received in the link connection part 75. Predetermined receiving space 75' may be formed inside the link connection part 75, and portions of the link block 60 and the bracket rotation part 44 may be received in the receiving space 75'. FIG. 5 illustrates a state prior to the insertion of the assembly of the link block 60 and the bracket rotation part 44 to the receiving space 75'.

Accordingly, when the link block 60 and the bracket rotation part 44 are received in the receiving space 75', the exposure of components related to rotation to the outside may be minimized even without being covered by a separate cover. Furthermore, the link connection part 75 may support the link block 60 and the bracket rotation part 44 at upper and lower part thereof, so the link connection part 75 may also serve to cover and protect the components related to the rotation. For example, the link connection part 75 may prevent a gap between the link block 60 and the bracket rotation part 44 from increasing during the rotation of the handle assembly H.

The receiving space 75' may be defined between the pair of the outer and inner plates 76*a* and 76*b* and a vertical plate 77 which constitute the link connection part 75, wherein the vertical plate 77 is provided between the pair of outer and inner plates 76*a* and 76*b*. The horizontal plate 76 may be composed of the outer plate 76*a* and the inner plate 76*b*. The outer plate 76*a* and the inner plate 76*b* may be spaced apart from each other and the receiving space 75' may be defined therebetween. Each of the horizontal plate 76 and the vertical plate 77 may be configured as a flat plate structure. For reference, FIG. 4 illustrates the horizontal plate 76 and the vertical plate 77 relative to the handle assembly H installed in a standing direction. When the handle assembly H is installed in a lying direction, the horizontal plate 76 may function as the vertical plate 77, and the vertical plate 77 may function as the horizontal plate 76.

In this case, the outer plate 76*a* arranged at an outer side may shield the upper part of the link block 60 and the open end part of the handle cover 80, respectively. Accordingly, in the embodiment, a separate part may not be required to shield the open part of the handle cover 80. The link connection part 75 receiving the link block 60 may be assembled with the handle cover 80 and may naturally shield the open part of the handle cover 80. Furthermore, in the embodiment, the upper surface of the outer plate 76*a* may be configured as a continuous flat surface and may be connected to the surface of the handle cover 80 to give the handle assembly H a natural appearance.

A handle fastening hole 77' may be formed at a side of the receiving space 75'. The handle fastening hole 77' may be formed by passing through or being recessed from the vertical plate 77 of the handle body 70, and may correspond to the block fastening hole 64 of the link block 60 described above. When the fastener 69 such as a bolt sequentially passes through the block fastening hole 64 and the handle fastening hole 77', the link block 60 may be fixed to the link connection part 75. Furthermore, the shielding plate 68 may be coupled to the link connection part 75, and may cover the entrance of the block fastening hole 64 located at the outside thereof and the periphery of the fastener.

Accordingly, the multiple assembly jaws 73 may be arranged at the handle body 70, and the link connection part 75 may be provided at the handle body 70. Particularly, the link connection part 75 may be a part configured to be coupled to the link block 60 so as to rotate therewith. To this end, the link connection part 75 including the horizontal plate 76 and the vertical plate 77 may have a relatively complex shape. However, since the handle body 70 is manufactured by injection molding, such a complex shape may be realized.

Next, the handle cover 80 will be described. The handle cover 80 may be assembled with the handle body 70 and, with the handle body 70, may constitute one handle assembly H. The handle cover 80 may cover the assembly surface 72 of the handle body 70, and simultaneously, may cover the front surface of the link connection part 75. Accordingly, most surfaces of the handle assembly H exposed to a user may be covered by the handle cover 80.

The handle cover 80 may be made of metal. For example, the handle cover 80 may be made of aluminum. Accordingly, when the handle cover 80 is made of metal, the exterior of the handle assembly may be luxurious, and the driving arm 85 may also be made of metal, so the wear and damage of the driving arm 85 occurring during operation may be decreased. In the embodiment, the entirety of the handle cover 80 may be made of metal. Alternatively, the handle cover 80 may be made of metal only in a portion thereof, or may be made by plating a metal material on the surface thereof, or may be made of various metal materials including stainless steel.

Specifically, the handle cover 80 may include a cover body 81 and the driving arm 85. The cover body 81 may correspond to the handlebar 71 of the handle body 70 and may be a part covering the assembly surface 72 which is the front surface of the handlebar 71. Accordingly, the cover body 81 may also have the shape of a long rod in one direction. In addition, the driving arm 85 may extend from the upper and lower parts 82 of the cover body 81, respectively, in directions different from the longitudinal direction (a z axis direction of FIG. 4) of the cover body 81, and may cover the front surface of the vertical plate 77 of the link connection part 75.

The assembly hooks 86 and 87 may be provided in the handle cover 80. The assembly hooks 86 and 87 may be intended to assemble the handle cover 80 with the handle body 70. In the embodiment, the assembly hooks 86 and 87 may be composed of the main hook 87 provided on the cover body 81 and the guide hook 86 provided on the driving arm 85. The guide hook 86 and the main hook 87 may be held in an edge of the handle body 70 and the assembly jaw 73, respectively.

The main hook 87 may be composed of the first hook 87*a* and the second hook 87*b*. The first hook 87*a* and the second hook 87*b* may protrude from the inner surface of the cover body 81. The first hook 87*a* and the second hook 87*b* may be held in the first assembly jaw 73*a* and the second assembly jaw 73*b*, respectively. As described above, the hook ends 87*a'* and 87*b'* formed at the end parts of the first hook 87*a* and the second hook 87*b*, respectively, may protrude in directions opposite to each other, and may be held in the first assembly jaw 73*a* and the second assembly jaw 73*b*, respectively. Accordingly, the first hook 87*a* and the second hook 87*b* may be held in the first assembly jaw 73*a* and the second assembly jaw 73*b*, respectively, by facing each other.

The guide hook 86 formed on the driving arm 85 may be made by inward bending the end part of the driving arm 85. The guide hook 86 may be held in and fixed to an edge of the handle body 70. More specifically, the guide hook 86 may be held in the outer edge of the vertical plate 77 constituting the link connection part 75. Referring to FIG. 11, the guide hook 86 is illustrated to be held in the edge of the vertical plate 77.

In this case, while the handle cover 80 rotates in a direction in which the handle cover 80 is in close contact with the handle body 70 with the guide hook 86 held in the edge of the vertical plate 77, the handle body 70 and the handle cover 80 may be assembled with each other. More specifically, when the handle cover 80 rotates in the direction in which the handle cover 80 is in close contact with the handle body 70 with the guide hook 86 held in the edge of the vertical plate 77, the first hook 87*a* and the second hook 87*b* may be held in and fixed to the first assembly jaw 73*a* and the second assembly jaw 73*b*, respectively.

Figure 15A:
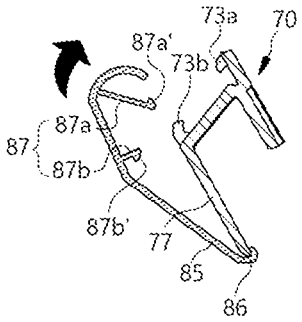
FIGS. 15A, 15B, and 15C are assembly views sequentially illustrating a process in which a handle cover is assembled with a handle body constituting the door opening device according to the embodiment of the present disclosure.
Figure 15B:
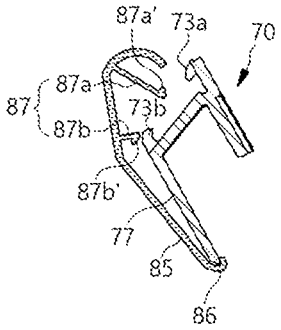
Figure 15C:
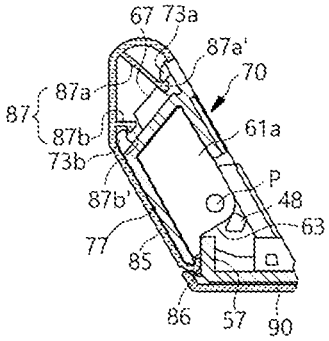

Referring to FIGS. 15A, 15B, and 15C, the assembling of the handle body 70 with the handle cover 80 will be described. First, when a worker holds the guide hook 86 of the driving arm 85 in the edge of the vertical plate 77, the state of FIG. 15A may be realized. In this case, the first hook 87*a* and the second hook 87*b* may be spaced away from the first assembly jaw 73*a* and the second assembly jaw 73*b*, respectively.

In this state, when the handle cover 80 is rotated in the direction of the arrow of FIG. 15A, the handle cover 80 may approach in the direction of covering the assembly surface 72 which is the front surface of the handle body 70. In this process, the second hook 87*b* may be in contact with the second assembly jaw 73*b*. However, the first hook 87*a* may not be in contact with the first assembly jaw 73*a* yet. This state is illustrated in FIG. 15B.

Accordingly, during the rotation of the handle cover 80, the second hook 87*b* may interfere with the second assembly jaw 73*b*. When a worker further rotates the handle cover 80 by overcoming elastic force of the second hook 87*b*, the second hook 87*b* may be elastically transformed to some extent and may move over the second assembly jaw 73*b*, and may be held in the second assembly jaw 73*b*. Next, when the handle cover 80 is further rotated in the direction of the arrow, the first hook 87*a* may move over the first assembly jaw 73*a*. Such a state is illustrated in FIG. 15C.

Referring to FIG. 15C, the handle assembly H is illustrated to be assembled with the link block 60, and the support body 67 of the link block 60 may protrude toward the handle cover 80. A portion of the support body 67 of the link block 60 protruding toward the handle cover 80 may support the first hook 87*a* and the second hook 87*b* therebetween, and may prevent the first hook 87*a* and the second hook 87*b* from being elastically transformed in the increasing directions of the distance between the first hook 87*a* and the second hook 87*b*. Accordingly, the state of the main hook 87 held in the assembly jaw 73 of the handle body 70 may be maintained.

In the embodiment, without a separate fastener or adhesive, the handle body 70 and the handle cover 80 may be assembled with each other. Particularly, when the guide hook 86 of the driving arm 85 is held in an edge of the vertical plate 77, the holding point may be an assembly reference point. Additionally, when the handle cover 80 is only rotated relative to such an assembly reference point, the handle body 70 and the handle cover 80 may be assembled with each other, so the handle body 70 and the handle cover 80 may be easily assembled with each other.

Particularly, the first hook 87*a* and the second hook 87*b* may have rotational radiuses different from each other. Accordingly, the first hook 87*a* and the second hook 87*b* may sequentially move over the first assembly jaw 73*a* and the second assembly jaw 73*b*, respectively. That is, the first hook 87*a* and the second hook 87*b* may be held in the first assembly jaw 73*a* and the second assembly jaw 73*b*, respectively, with time difference, so force required to assemble the handle body 70 and the handle cover 80 with each other may be distributed. In this case, a worker may not be required to exert force at once to overcome the elastic forces of the first hook 87*a* and the second hook 87*b*, but may distribute the force. More specifically, the rotational radius of the second hook 87*b* may be shorter than the rotational radius of the first hook 87*a*. Accordingly, the second hook 87*b* may first touch the second assembly jaw 73*b* (see FIG. 15B). Furthermore, in the embodiment, the length of the second hook 87*b* may be shorter than the length of the first hook 87*a*.

Meanwhile, the driving arm 85 provided in the handle cover 80 may extend from the upper and lower parts 82 from the handle cover 80. The driving arm 85 may function as a cover covering the vertical plate 77 of the link connection part 75, and simultaneously, may function to push the push rod 50. That is, during the rotation of the handle assembly H, the driving arm 85 may naturally push the push rod 50.

Figure 8:
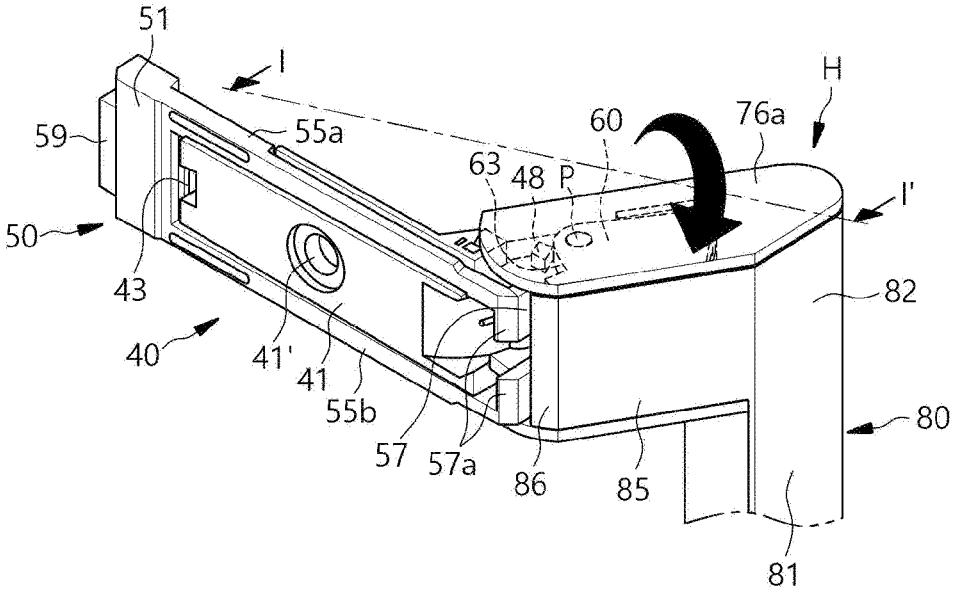
FIG. 8 is a perspective view illustrating a state of the handle assembly in which the handle assembly constituting the door opening device is located in an initial position according to the embodiment of the present disclosure.
Figure 9:
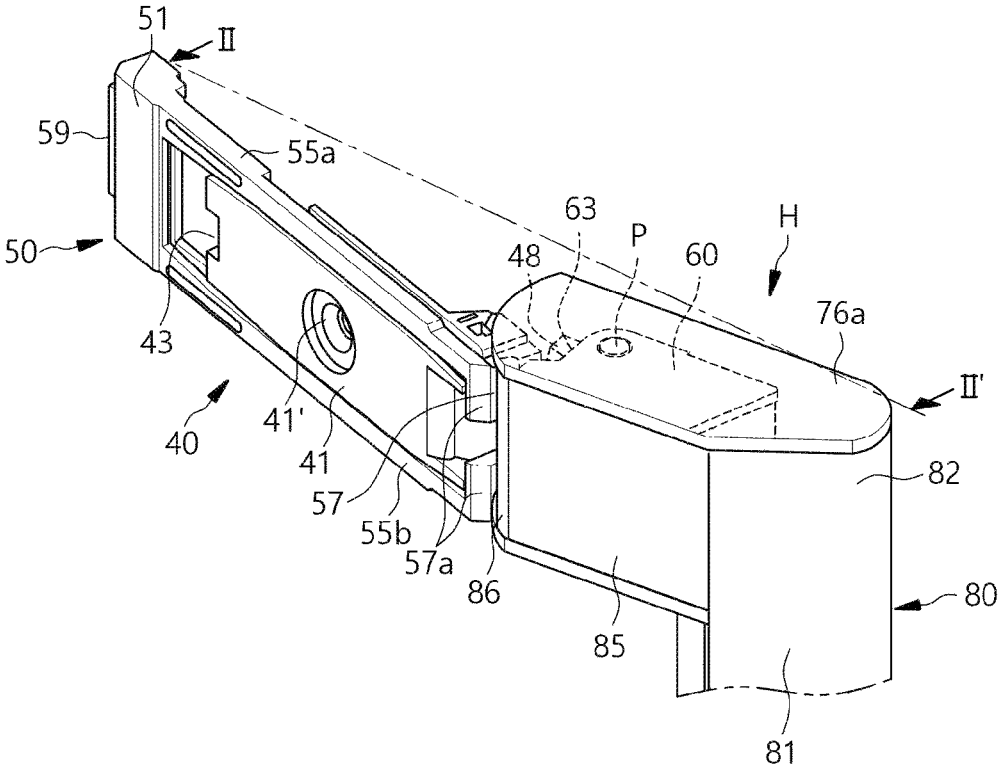
FIG. 9 is a perspective view illustrating the protruding state of a push rod due to the rotation of the handle assembly constituting the door opening device according to the embodiment of the present disclosure.
Figure 10:
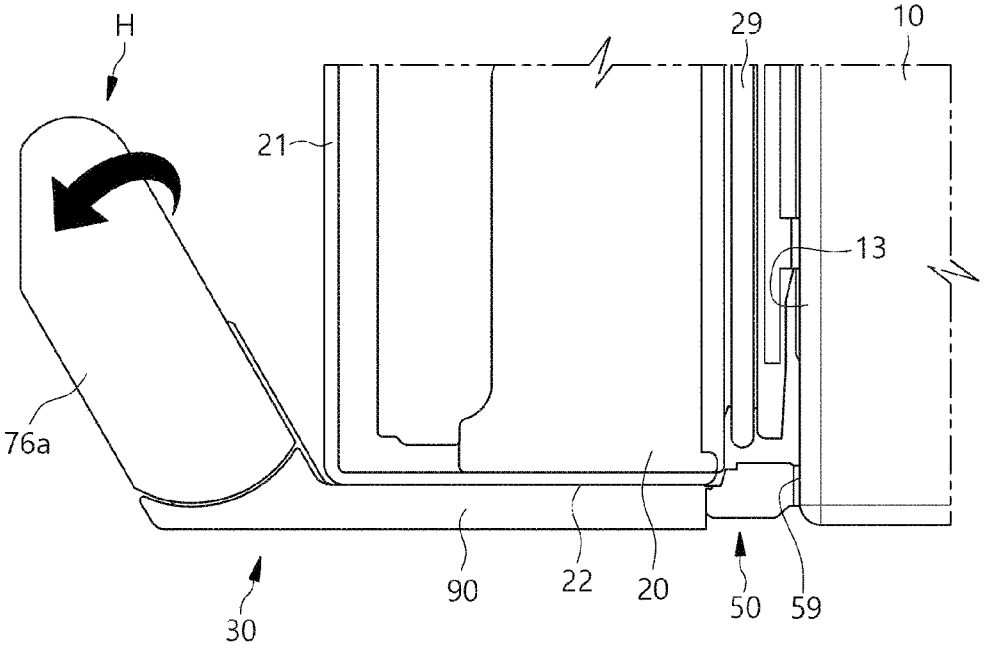
FIG. 10 is a top plan view illustrating the state of the handle assembly located in the initial position according to the embodiment of the present disclosure.

More specifically, the periphery of the guide hook 86 of an end part of the driving arm 85 may press the pressed part 57 of the push rod 50. Referring to FIG. 8, the surface of the guide hook 86 of the driving arm 85 may be in close contact with the pressed part 57. In this state, when the handle assembly H is rotated in the direction of an arrow, the entirety of the driving arm 85 may be moved in a direction of the push rod 50. In this process, the surface of the guide hook 86 may press the pressed part 57.

When the push rod 50 is pressed by the driving arm 85, the entirety of the push rod 50 may rectilinearly move on the guide part 42 of the guide bracket 40. The push rod 50 may protrude in the direction protruding toward the front surface 13 of the cabinet 11, that is, in the direction of the arrow of FIG. 13. The push rod 50 may allow the cabinet 11 and the door assembly 20 to be spaced apart from each other by the protruding length of the push rod 50. Accordingly, the rotational motion of the handle assembly H may be converted to the rectilinear motion of the push rod 50, so a user may increase distance between the cabinet 11 and the door assembly 20 with little force.

In addition, the entirety of the handle cover 80 including the driving arm 85 may be made of metal, so in the process of cooperative operation of the driving arm 85 and the push rod 50 with each other, the driving arm 85 may be prevented from being worn. Additionally, the guide hook 86 having a curved shape provided at the end part of the driving arm 85 may press the surface of the pressed part 57 of the push rod 50, so the risk that the pressed part 57 of the push rod 50 is worn or damaged while being pressed may be reduced.

Referring to FIG. 4, the handle body 70 may have a relatively complex shape, but the handle cover 80 may include the first hook 87*a* and the second hook 87*b* formed continuously along the longitudinal direction thereof and may be configured only as a very simple structure as a whole. Particularly, the driving arm 85 may have a simple structure extending from the cover body 81, and may function as a cover covering the vertical plate 77 of the link connection part 75 of the handle body 70, and may function to push the push rod 50 during the rotation of the driving arm 85. Accordingly, the handle assembly H may not require a complex structure performing cooperative operation to push the push rod 50.

In the embodiment, the handle body 70 may be located at a side inner than the handle cover 80, that is, at a side closer to the cabinet 11. Accordingly, when a user pulls the handle assembly H by applying force thereto by gripping the handle assembly H, a part to which the force is applied may be the handle body 70. The handle body 70 may be made of synthetic resin. When a user grips the handle assembly, the synthetic resin may transmit less coldness than metal, which may improve gripping feeling. Of course, the handle body 70 may also be made of metal as the handle cover 80 to be described later is made, or may be made of both metal and synthetic resin by the insert-injection method.

In addition, referring to FIG. 12, the driving arm 85 constituting the handle cover 80, with the support part 63*a*, may be in contact with the same surface of the pressed part 57. The surface 86*a* of the guide hook 86 which is the end part of the driving arm 85, with the surface 63*a*' of the support part 63*a*, may support the same surface of the pressed part 57. Accordingly, the support part 63*a* and the driving arm 85 may be located on the same line K. Accordingly, the support part 63*a* and the driving arm 85 may together support the push rod 50, so the shaking of the push rod 50 may be more reliably prevented.

Meanwhile, in the embodiment, the cover body 81 constituting the handle cover 80 and the driving arm 85 extending from the cover body 81 may have the same cross-sectional shapes along the longitudinal direction of the handle cover 80. The cover body 81 and the driving arm 85 may have the same cross-sectional shapes without undercuts along the longitudinal direction of the handle cover 80, so the handle cover 80 may be easily made of metal. That is, according to the embodiment, the handle cover 80 may not be manufactured by casting, but may be made by extruding or drawing.

Referring to FIG. 11, in the cross section of the handle cover 80, a pair of the first hook and the second hook, and the guide hook 86 may protrude to have cantilever shapes, and the remaining portion of the handle cover 80 may constitute the outside of the handle cover 80. Accordingly, according to the embodiment, the handle cover 80 may have a very simple structure. This is because a relatively complex structure configured to be coupled to and receive the link block 60 may be constituted by the handle body 70.

According to the embodiment, the operation process of the door opening device 30 will be described hereinafter. First, when a user pulls the handle assembly H in a direction toward the user's body (in direction of arrow ①) of FIG. 7A) by gripping the handle assembly H, the entirety of the handle assembly H may be rotated to some extent in a direction toward the outside (in direction of arrow ② of FIG. 7A, so the state of FIG. 7B may be realized.

In this case, during the rotation of the handle assembly H, the periphery of the guide hook 86 formed at the end part of the driving arm 85 of the handle cover 80 may press the pressed part 57 formed on the push rod 50. Referring to FIG. 8, the surface of the guide hook 86 formed at the end part of the driving arm 85 is illustrated to be in close contact with the pressed part 57. For reference, FIG. 8 is a state prior to the rotation of the handle assembly H of FIG. 7A.

In this state, when the handle assembly H is rotated in the direction of the arrow of FIG. 8, the entirety of the driving arm 85 may move in the direction of the push rod 50. In this process, the surface of the guide hook 86 may press the pressed part 57. When the push rod 50 is pressed by the driving arm 85, the entirety of the push rod 50 may rectilinearly move on the guide part 42 of the guide bracket 40.

Figure 13:
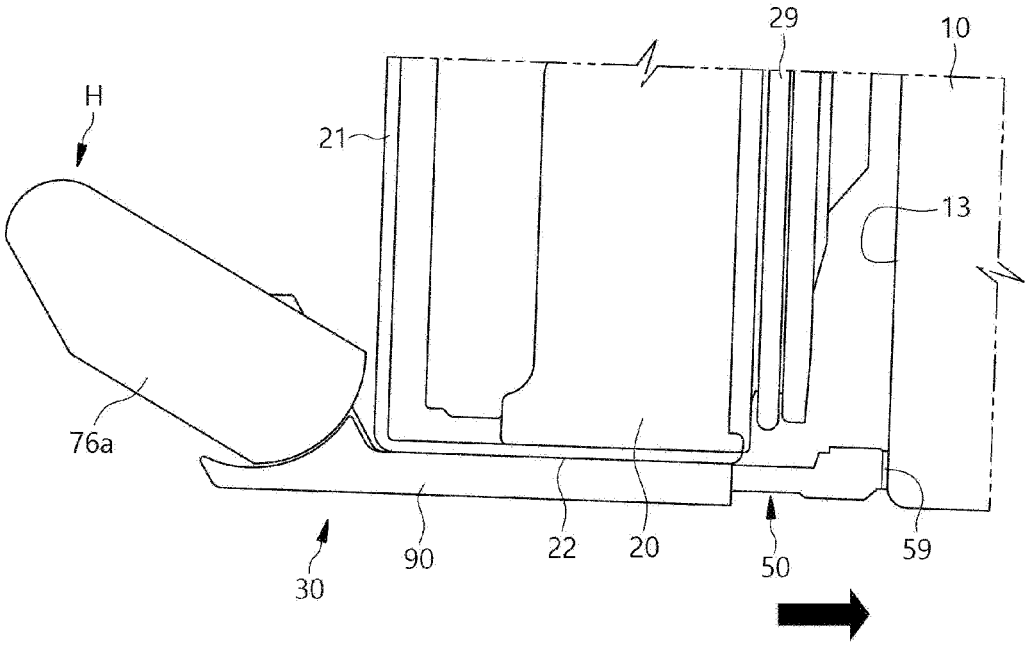
FIG. 13 is a top plan view illustrating the protruding state of the push rod due to the rotation of the handle assembly according to the embodiment of the present disclosure.
Figure 14:
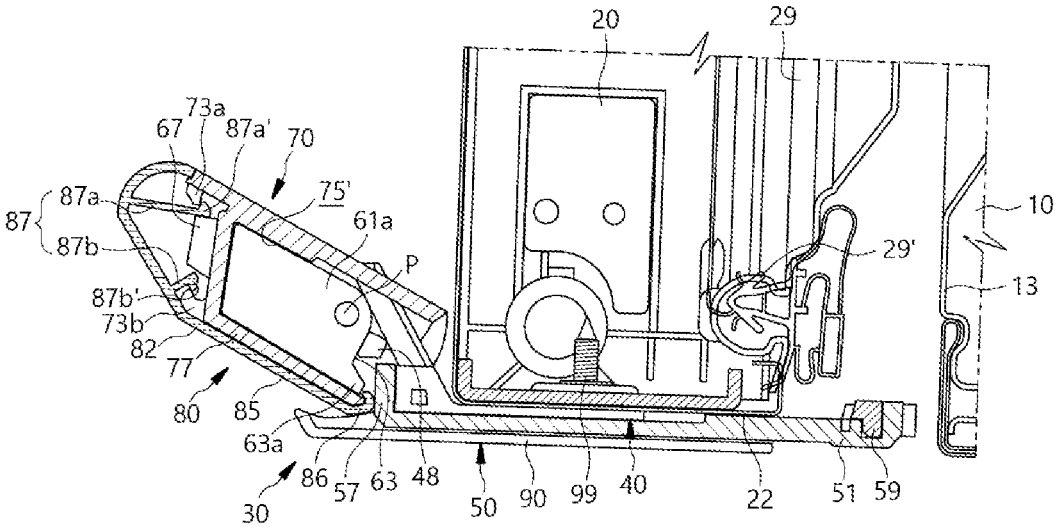
FIG. 14 is a cross-sectional view taken along line II-II' of FIG. 9.

The push rod 50 may protrude toward the front surface 13 of the cabinet 11, that is, in direction of the arrow of FIG. 13, and may allow the cabinet 11 and the door assembly 20 to be spaced apart from each other by the protruding length of the push rod 50. Accordingly, the rotational motion of the handle assembly H may be converted to the rectilinear motion of the push rod 50, so a user may increase distance between the cabinet 11 and the door assembly 20 with little force.

In addition, in the embodiment, the entirety of the handle cover 80 including the driving arm 85 may be made of metal, so the driving arm 85 may be prevented from being worn during the cooperative operation of the driving arm 85 with the push rod 50. Additionally, the guide hook 86 formed at the end part of the driving arm 85 and having a curved shape may press the surface of the pressed part 57 of the push rod 50, so while the pressed part 57 is pressed, the risk of the wear or damage of the pressed part 57 of the push rod 50 may be reduced.

Next, the process of assembling the parts constituting the door opening device according to the embodiment will be described with reference with FIG. 4. The parts may largely be composed of two assemblies. One of the two assemblies may be an assembly composed of the guide bracket 40, the push rod 50, and the link block 60, and the remaining one of the two assemblies may be the handle assembly H composed of the handle body 70 and the handle cover 80. After a worker assembles the each of two assemblies, the assembly composed of the guide bracket 40, the push rod 50, and the link block 60 may be assembled with the handle assembly H. Additionally, finally, the door opening device 30 may be assembled with the side surface of the door assembly 20.

The assembling of the guide bracket 40 with the push rod 50 will be described. With the pair of guide legs 55 constituting the push rod 50 spaced apart from each other, the push rod 50 may be fitted to the guide parts 42 of the guide bracket 40. In this case, the push block 59 may be assembled with the push rod 50. The push rod 50 may be fitted to the guide bracket 40 by a separate fastener, so the push rod 50 may slide forward and rearward along the guide parts 42.

Next, the link block 60 may be coupled to the bracket rotation part 44 of the guide bracket 40. The pair of link plates 61*a* and 61*b* of the link block 60 may be laminated on the outer surfaces of the pair of rotating plates 45*a* and 45*b* of the bracket rotation part 44. When the rotating plate unit 45 and the link plate unit 61 are laminated, the position of the first shaft hole 45' of the rotating plate unit 45 and the position of the second shaft hole 62 of the link plate unit 61 may correspond to each other. In this state, the rotating shaft P may pass through each of the first shaft hole 45' and the second shaft hole 62. Accordingly, when the rotating shaft P passes through the first shaft hole 45' and the second shaft hole 62, the rotating shaft P may be a rotation center when the link block 60 rotates relative to the bracket rotation part 44.

In this case, the return spring S may be fitted over the rotating shaft P, and the opposite ends Sa and Sb of the return spring S may be supported by the bracket rotation part 44 and the link block 60, respectively. Accordingly, during the rotation of the link block 60, the return spring S may accumulate elastic energy. When an external force rotating the link block 60 is removed, the link block 60 and the handle assembly H may be moved to initial positions thereof by the accumulated elastic energy.

Meanwhile, as illustrated in FIGS. 15A, 15B, 15C, in the handle assembly H, when a worker rotates the handle cover 80 in a direction of an arrow with the guide hook 86 of the driving arm 85 held in an edge of the vertical plate 77 (FIG. 15A), the handle cover 80 may approach in the direction of covering the assembly surface 72 of the handle body 70. In this process, the second hook 87*b* may be in contact with the second assembly jaw 73*b*. More specifically, as illustrated in FIG. 15B, the second hook 87*b* may interfere with the second assembly jaw 73*b*. However, the first hook 87*a* may not be in contact with the first assembly jaw 73*a* yet.

In addition, when a worker further rotates the handle cover 80 by overcoming the elastic force of the second hook 87*b*, the second hook 87*b* may be elastically transformed to some extent and may move over the second assembly jaw 73*b*, and may be held in the second assembly jaw 73*b*. Next, when the handle cover 80 is further rotated in the direction of the arrow, the first hook 87*a* may move over the first assembly jaw 73*a*. Such a state is illustrated in FIG. 15C.

Finally, a worker may assemble the assembly of the guide bracket 40, the push rod 50, and the link block 60 which are assembled with each other with the handle assembly H. In this case, the block fastening hole 64 may be formed in the link block 60. When the fastener such as a bolt is fastened to the handle body 70 by passing through the block fastening hole 64, the link block 60 may be fixed to the handle body 70.

Figure 16:
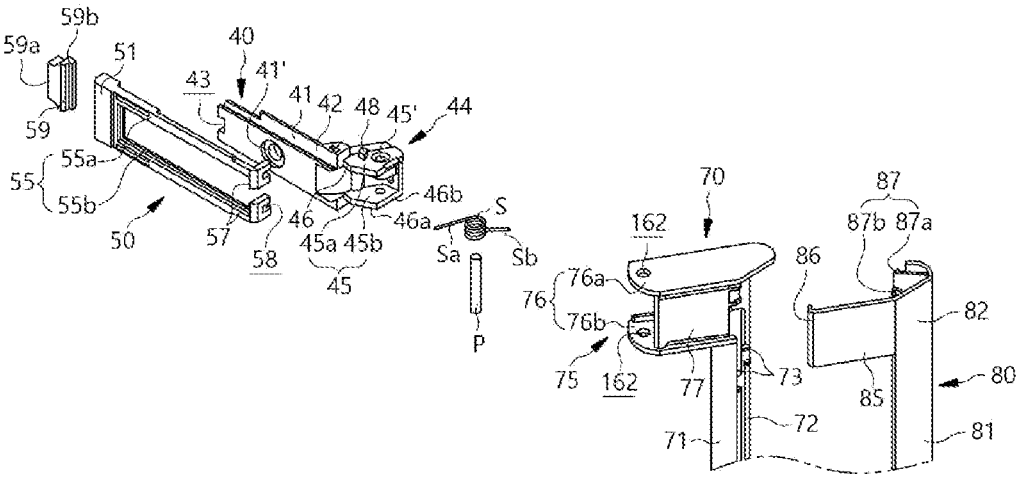
FIG. 16 is a perspective view illustrating the door opening device according to another embodiment of the present disclosure.

Accordingly, in the embodiment, the link block 60 may be assembled with the handle assembly H, and may enable the handle assembly H to be rotated. The link block 60 may be omitted and the function of the link block 60 may be performed directly by the handle body 70. As illustrated in FIG. 16, an assembly hole 162 may be formed in the handle body 70. The assembly hole 162, with the first shaft hole 45' of the bracket rotation part 44, may be a part through which the rotating shaft P passes. The assembly hole 162 may be configured to completely pass through the handle body 70 or to be repressed from the handle body 70. Additionally, a separate shielding cover for shielding the assembly hole 162 may be provided.

Figure 17:
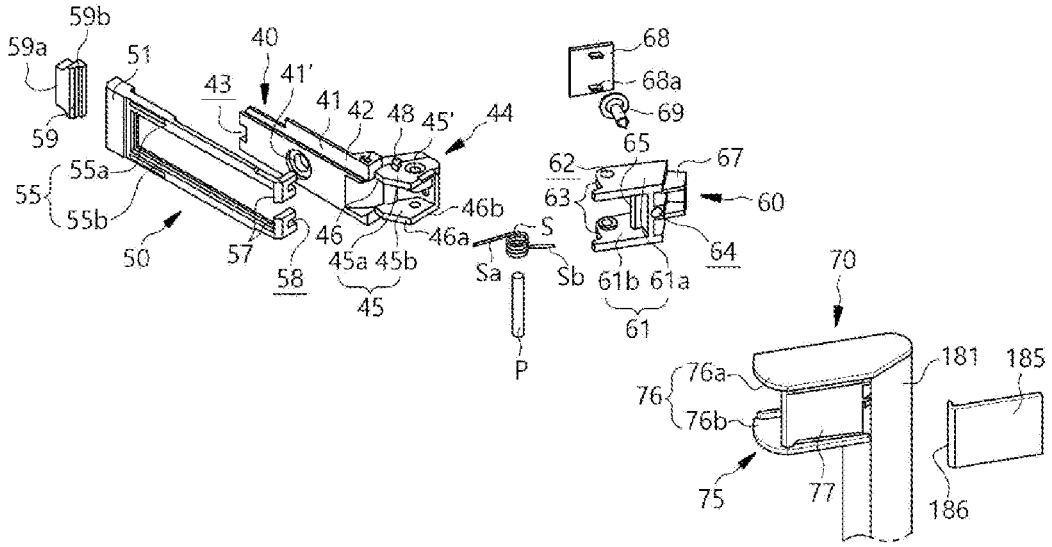
FIG. 17 is a perspective view illustrating the door opening device according to still another embodiment of the present disclosure.

In addition, the handle cover 80 may not be required to necessarily cover the entirety of the front surface of the handle body 70. As illustrated in FIG. 17, only the driving arm may be a handle cover 185. The handle cover 185 may have a guide hook 186 formed at an end part thereof and may be made of metal, so the handle cover 185 may be assembled with the handle body 70. Additionally, the front surface of the handle body 70 may be shielded by a separate part 181, or the handle cover 185 may be configured to be integrated with the handle body 70. Alternatively, the handle cover 185 may be composed of several parts.

What is claimed is:

1. A door opening device for an appliance that includes a cabinet and a door rotatably coupled to the cabinet, the door opening device comprising:

a guide bracket configured to be fixed to the door;

a push rod coupled to the guide bracket and configured to move along the guide bracket and push the cabinet; and a handle assembly rotatably coupled to the guide bracket, the handle assembly comprising:

a handle body that extends in a longitudinal direction, the handle body having a first end and a second end that are spaced apart from each other in the longitudinal direction, and a handle cover that is coupled to the handle body and defines an exterior of the handle assembly, the handle cover extending along the handle body in the longitudinal direction from the first end of the handle body to the second end of the handle body, wherein the handle cover comprises a driving arm coupled to the first end or the second end of the handle body and configured to push the push rod based on rotation of the handle assembly relative to the guide bracket.

2. The door opening device of claim 1, wherein the handle body comprises a handlebar, wherein the handle cover comprises a cover body that covers a front surface of the handlebar, and wherein the driving arm extends from the cover body toward the push rod and covers a connection portion that connects the handle body and the guide bracket to each other.

3. The door opening device of claim 1, wherein the handle cover comprises a cover body that extends in the longitudinal direction from an upper part of the cover body toward a lower part of the cover body, wherein the driving arm extends from the upper part or the lower part of the cover body toward the push rod, wherein a cross-sectional shape of the cover body is maintained between the upper part and the lower part of the cover body along the longitudinal direction, and wherein the handle body covers open ends of the upper part and the lower part of the cover body.

4. The door opening device of claim 1, wherein the driving arm is manufactured integrally with the handle cover.

5. The door opening device of claim 1, further comprising a link block that rotatably couples the handle body to the guide bracket, wherein the handle body and the link block are configured to rotate relative to the guide bracket.

6. The door opening device of claim 5, wherein the push rod comprises a pressed part configured to be in contact with a surface of the link block based on the handle body being in an initial position, and wherein the driving arm is configured to, based on the handle body being in the initial position, be in contact with the surface of the link block.

7. The door opening device of claim 5, wherein the handle body comprises:

a handlebar that extends in the longitudinal direction; and a link connection part that extends from the handlebar and is coupled to the link block.

8. The door opening device of claim 7, wherein the link connection part covers at least a portion of the link block, and wherein the handle cover is coupled to front surfaces of the handlebar and the link connection part.

9. The door opening device of claim 7, wherein the link connection part comprises horizontal plates comprising an inner plate and an outer plate that extend from the handlebar and that are spaced apart from each other in the longitudinal direction, the outer plate being arranged at an outer side of the handle body relative to the inner plate in the longitudinal direction, and wherein the outer plate covers each of an upper part of the link block and an open end part of the handle cover.

10. The door opening device of claim 7, wherein the guide bracket comprises a bracket rotation part, at least a portion of the bracket rotation part being rotatably connected to the link block and inserted into the link block, and wherein the link connection part is configured to receive at least a portion of each of the link block and the bracket rotation part.

11. The door opening device of claim 7, wherein the guide bracket comprises a bracket rotation part rotatably connected to the link block by a rotating shaft, and wherein the door opening device further comprises a return spring located at the rotating shaft and configured to apply rotational force to the link block to thereby move the link block to an initial position.

12. The door opening device of claim 7, wherein the guide bracket comprises a bracket rotation part connected to the link block, the bracket rotation part comprising a bracket stopper that protrudes from a surface of the bracket rotation part, and wherein the link block comprises a stopping surface configured to, based on the link block rotating to the guide bracket, interfere with the bracket stopper to thereby limit rotation of the link block.

13. The door opening device of claim 12, wherein the link block comprises:

a rotating shaft rotatably coupled to the guide bracket; and a stopping rib that protrudes from the link block and extends parallel to the rotating shaft, the stopping rib being configured to, based on the link block rotating to the guide bracket, interfere with the bracket rotation part to thereby limit rotation of the link block.

14. The door opening device of claim 1, wherein the push rod comprises:

a push head configured to push the cabinet; and a pair of guide legs that extend from the push head toward the driving arm, each of the pair of guide legs having a cantilever shape and being connected to the guide bracket, and wherein each of the pair of guide legs comprises a pressed part located at an end part thereof and configured to be pressed by the driving arm.

15. The door opening device of claim 14, wherein the guide bracket comprises a bracket rotation part configured to guide the push rod that moves linearly, and wherein the push rod defines a guide groove recessed from the pressed part and engaged with the bracket rotation part.

16. A door opening device for an appliance that includes a cabinet and a door rotatably coupled to the cabinet, the door opening device comprising:

a guide bracket configured to be fixed to the door;

a push rod coupled to the guide bracket and configured to move along the guide bracket and push the cabinet; and a handle assembly rotatably coupled to the guide bracket, the handle assembly comprising:

a handle body, and a handle cover that is coupled to the handle body and defines an exterior of the handle assembly, the handle cover comprising a driving arm made of metal and configured to push the push rod based on rotation of the handle assembly relative to the guide bracket, wherein the handle body comprises an assembly jaw, wherein the handle cover comprises an assembly hook configured to couple to the assembly jaw based on the handle body and the handle cover being assembled with each other, wherein the assembly hook comprises:

a guide hook located at an end of the driving arm and coupled to an edge of the handle body, and a main hook that protrudes from an inner surface of the handle cover toward the handle body and is coupled to the assembly jaw, and wherein the guide hook and the main hook extend parallel to a longitudinal direction of the handle body.

17. The door opening device of claim 16, wherein the main hook is configured to move toward and interfere with the assembly jaw based on the handle cover rotating about the edge of the handle body that is in contact with the guide hook.

18. The door opening device of claim 17, further comprising a link that extends from the handle body toward the handle cover and supports the main hook.

19. The door opening device of claim 17, wherein the assembly jaw comprises a first assembly jaw and a second assembly jaw that are spaced apart from each other, wherein the main hook comprises a first hook and a second hook that are configured to couple to the first assembly jaw and the second assembly jaw, respectively, based on the handle cover rotating toward the handle body about the edge of the handle body that is in contact with the guide hook, and wherein the first hook and the second hook are configured to rotate toward the handle body along paths having different radii of curvature from each other.

20. A refrigerator comprising:

a cabinet that defines a storage room;

a door assembly rotatably coupled to the cabinet and configured to open and close at least a portion of the storage room; and a door opening device coupled to the door assembly and configured to move the door assembly away from the cabinet, the door opening device comprising:

a guide bracket fixed to the door assembly, a push rod coupled to the guide bracket and configured to move along the guide bracket and push the cabinet, and a handle assembly rotatably coupled to the guide bracket, wherein the handle assembly comprises:

a handle body that extends in a longitudinal direction, the handle body having a first end and a second end that are spaced apart from each other in the longitudinal direction, and a handle cover that is coupled to the handle body and defines an exterior of the handle assembly, the handle cover extending along the handle body in the longitudinal direction from the first end of the handle body to the second end of the handle body, and wherein the handle cover comprises a driving arm coupled to the first end or the second end of the handle body and configured to push the push rod based on rotation of the handle assembly relative to the guide bracket.

* * * * *